US007221896B2

(12) United States Patent
Yoshimura et al.

(10) Patent No.: US 7,221,896 B2
(45) Date of Patent: May 22, 2007

(54) FIXING DEVICE FOR FIXING AN UNFIXED DEVELOPING AGENT ON A RECORDING MEDIUM AND IMAGE FORMING APPARATUS INCLUDING THE SAME

(75) Inventors: Hisashi Yoshimura, Nara (JP); Hirokazu Nakamura, Nara (JP); Masaki Matsushita, Ikoma-gun (JP); Hirokazu Fujita, Nara (JP); Naozumi Ueno, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 237 days.

(21) Appl. No.: 11/007,757

(22) Filed: Dec. 7, 2004

(65) Prior Publication Data

US 2005/0123330 A1 Jun. 9, 2005

(30) Foreign Application Priority Data

Dec. 9, 2003 (JP) ..... 2003-410699
Dec. 9, 2003 (JP) ..... 2003-410713

(51) Int. Cl.
*G03G 15/20* (2006.01)

(52) U.S. Cl. ..... 399/328; 399/330

(58) Field of Classification Search ..... 399/323, 399/330

See application file for complete search history.

(56) References Cited

U.S. PATENT DOCUMENTS 4,420,680 A * 12/1983 Itoh ..... 219/469
5,678,161 A 10/1997 Kurataka et al.
6,690,404 B2 * 2/2004 Shimada et al. ..... 347/115
6,795,678 B2 * 9/2004 Yura et al. ..... 399/329

(Continued)

FOREIGN PATENT DOCUMENTS

JP 59-071075 4/1984

(Continued)

*Primary Examiner*—Walter Benson
(74) *Attorney, Agent, or Firm*—David G. Conlin; William J. Daley, Jr.; Edwards Angell Palmer & Dodge LLP

(57) ABSTRACT

A fixing device of the present invention includes a pressure roller and a peeling roller both of which press a heat roller. The pressure roller is disposed upstream to the peeling roller in a transport direction of a recording paper. An outer diameter of the heat roller, an outer diameter of the pressure roller, and an outer diameter of the peeling roller decrease in this order. With this arrangement, it is possible to realize a fixing device which achieves a reduced size and reduced power requirements, while ensuring a fixing property and a peeling property with respect to a recording medium.

Further, with an arrangement in which the pressure roller and the peeling roller which press the heat roller are disposed so that, in a cross section orthogonal to central axes of the heat roller, the pressure roller, and the peeling roller, a first orthogonal line being orthogonal to a first line that connects a center of the heat roller and a center of the pressure roller and passing through a nip portion between both of the rollers, comes into contact with a contact area in a predetermined area on a peripheral surface of the peeling roller, a fixing device of the present invention can transport the recording paper without causing a paper jam when plural pieces of recording paper stacked are transported.

21 Claims, 6 Drawing Sheets

U.S. PATENT DOCUMENTS

| | | | | |
|---|---|---|---|---|
| 6,813,464 | B2 * | 11/2004 | Amita et al. | 399/323 |
| 2004/0156659 | A1 * | 8/2004 | Ando et al. | 399/323 |

FOREIGN PATENT DOCUMENTS

| | | | |
|---|---|---|---|
| JP | 05-165361 | | 7/1993 |
| JP | 5-063795 | B2 | 9/1993 |
| JP | 5-273881 | A | 10/1993 |
| JP | 08272246 | A | 10/1996 |
| JP | 09-044030 | | 2/1997 |
| JP | 11-084924 | | 3/1999 |
| JP | 3084692 | B2 | 7/2000 |
| JP | 2001-042676 | A | 2/2001 |
| JP | 2001-092296 | A | 4/2001 |
| JP | 2002-229368 | | 8/2002 |
| JP | 2003-005557 | | 1/2003 |
| JP | 2003-098874 | | 4/2003 |
| JP | 2003-156959 | | 5/2003 |
| JP | 2003-177623 | | 6/2003 |
| JP | 2003-260723 | | 9/2003 |
| JP | 2003-297526 | | 10/2003 |

* cited by examiner

FIXING DEVICE FOR FIXING AN UNFIXED DEVELOPING AGENT ON A RECORDING MEDIUM AND IMAGE FORMING APPARATUS INCLUDING THE SAME

This Nonprovisional application claims priority under 35 U.S.C. § 119(a) on Patent Application No. 2003/410713 filed in Japan on Dec. 9, 2003 and Patent Application No. 2003/410699 filed in Japan on Dec. 9, 2003, the entire contents of which are hereby incorporated by reference.

FIELD OF THE INVENTION

The present invention relates to a fixing device fixing an unfixed developing agent on a recording medium, as well as an image forming apparatus including the fixing device.

BACKGROUND OF THE INVENTION

Generally, in electrophotographic image forming apparatuses, the volume of toner for use in forming toner images on a recording paper during color printing is greater than the volume of toner during monochrome printing. Therefore, in color printing, for realization of an excellent fixing of toner images on the recording paper, there is a demand for a fixing device for use in a color image forming apparatus, enhancing a property of releasing a toner from a fixing roller and a property of peeling a recording paper, or a property of melting color toners.

For example, Japanese Patent No. 3084692 (registered on Jul. 7, 2000) discloses a belt nip fixing device including a fixing roll which provides a nip portion by coming into contact with an endless belt rotatably laying in a tensioned state across the supporting rolls, the fixing device having an arrangement which enhances a property of peeling the recording paper. In the fixing device described in the publication, a pressure roll which presses the fixing roller via the endless belt is provided at an exit of the nip portion. This pressure roll, at the exit of the nip portion, causes a micro slip in an interface between a toner on the recording paper and the fixing roll, so that it is possible to peel the recording paper even in color printing, without using a peeling device.

Japanese Laid-Open Patent Application No. 42676/2001 (Tokukai 2001-42676; published on Feb. 16, 2001) and Japanese Laid-Open Patent Application No. 92296/2001 (Tokukai 2001-92296; published on Apr. 6, 2001) disclose fixing devices each having a plurality of nip portions provided when a fixing roller (heat roller) comes into contact with pressure rollers. These fixing devices have a plurality of nip portions, thereby sufficiently giving a recording material the amount of heat required for fixing, without decreasing a speed of a recording-material heating process. With this arrangement, even in color printing, toner images are melted and firmly adhered on the recording paper, thus forming fixing images in an excellent manner.

Further, in a fixing device described in the above-mentioned Japanese Laid-Open Patent Application No. 42676/2001, the rollers, which provide a plurality of nip portions, are made different in harness between each other, so that no paper jam occurs when the recording paper goes into a second nip portion downstream in the transport direction of the recording paper after the recording paper passes through a first nip portion upstream in the transport direction of the recording paper. That is, in a fixing device described in the above-mentioned Japanese Laid-Open Patent Application No. 42676/2001, when a pressure is applied to the rollers mutually different in hardness, a roller having a low hardness deforms along the shape of a roller having a high hardness. Therefore, when the recording paper passes between the rotated rollers in a state where the roller having a low hardness deforms, the recording paper is transported along the roller having a high hardness. Paying attention to this property, the above-mentioned Japanese Laid-Open Patent Application No. 42676/2001 sets degrees of hardness for the respective rollers so that the recording paper having passed through the first nip portion reliably enters the second nip portion, thus decreasing the occurrence of a paper jam.

Still further, in the fixing device described in Japanese Laid-Open Patent Application No. 92296/2001, a pressure applied to the recording paper at a nip portion upstream in the transport direction of the recording paper is lower than a pressure applied to the recording paper at a nip portion downstream in the transport direction of the recording paper. Therefore, a pressure to be applied to a recording material is lowered at an earlier stage of a heating process, and the pressure to be applied to a recording material is increased at a later stage of the heating process so that the occurrence of heat bumps in toners is suppressed, thus realizing an excellent fixing of toner images.

Yet further, a fixing device including a plurality of nip portions is also described in Japanese Examined Patent Publication No. 63795/1993 (Tokukouhei 5-63795; published on Sep. 13, 1993). The fixing device described in this publication is provided with one fixing roller and a plurality of contact rollers: primary contact roller and secondary contact roller, to perform recording on a supporting body, such as an envelope that is a combination of plural pieces of paper, without causing the supporting body to become crinkled. First, using the secondary contact roller, the supporting body is winded around the fixing roller. Then, by controlling a rotation speed of the secondary contact roller, the supporting body is transported between the fixing roller and the primary contact roller. Thus, provision of the secondary contact roller enhances a property of bringing the supporting body into intimate contact with the fixing roller, and enhances a property of fixing toner images.

In recent years, there is a demand for an image forming apparatus with reduced power requirements and reduced size. With this, there is a demand for a fixing device with reduced power requirements and reduced size, included in an image forming apparatus. Therefore, it is desired that the fixing device achieves reduced power requirements and reduced size while ensuring an excellent property of fixing toner images onto the recording paper. Especially, in recent years, a full-color printing using an image forming apparatus including a fixing device has been increasingly performed, and there is also a demand for an image forming apparatus capable of monochrome printing and full-color printing, with reduced power requirements and reduced size. To respond to such a demand, the conventional fixing device still has a further room for improvement.

For example, conventionally, in order to realize reduced power requirements of a fixing device, the fixing roller is made thin so that a heat capacity of the fixing roller can be reduced. However, the thin-walled fixing roller is susceptible to deformation caused by contact of the pressure roller with the fixing roller. Therefore, in order to prevent damage to the fixing device due to deformation of the fixing roller, it is necessary to control a nip pressure when the pressure roller comes into contact with the fixing roller.

However, under the condition where the volume of toner fixed on the recording paper is large in full-color printing and the like printing, the use of the thin-walled fixing roller does not ensure a sufficient nip pressure, causing the difficulty in ensuring an excellent property of fixing toner images. Therefore, conventionally, the thin-walled fixing roller was not suitable for full-color printing.

In addition, the conventional fixing device do enhances a property of bringing the recording paper into intimate contact with the fixing roller in an area between a first nip portion and a second nip portion (between the nips), but there is no element for pushing the recording paper to the fixing roller in the area between the nips. Therefore, there is the possibility that the recording paper could be transported without intimate contact with the fixing roller in the area between the nips.

For example, in the fixing device described in the above-mentioned Japanese Examined Patent Publication No. 63795/1993 (Tokukouhei 5-63795; published on Sep. 13, 1993), when the recording paper is transported without intimate contact with the fixing roller in the area between the nips, a leading end part of the recording paper having passed through the first nip portion which is provided by the fixing roller and the secondary contact roller comes into contact with the main contact roller. This could cause a paper jam.

Therefore, the conventional fixing device having two nip portions still has a further room for improvement that brings an excellent transport of the recording paper in the area between the nips.

SUMMARY OF THE INVENTION

The present invention has been made to solve the conventional problem, and a first object of the present invention is to provide: (i) a fixing device which can achieve reduction of warm-up time, reduction of the amount of electrical power required for warm-up, and size reduction of the fixing device, and perform a fixing process in a preferred and excellent manner, even when a thin-walled heat roller is used, in both full-color printing and monochrome printing; and (ii) an image forming apparatus including the fixing device.

A second object of the present invention is to provide: (i) a fixing device which can realize an excellent transport of the recording medium without causing a paper jam and other troubles in an area between nips and perform a fixing process in a preferred and excellent manner; and (ii) an image forming apparatus including the fixing device.

A fixing device according to the present invention, in order to achieve the first and second objects, includes: a fixing roller; and a plurality of pressure rollers providing respective nip portions by pressing the fixing roller, wherein the fixing roller and the pressure rollers rotate, thereby transporting a recording medium to the nip portions and fixing a developing agent on the recording medium, the plurality of pressure rollers including: a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, the first pressure roller being disposed upstream to the second pressure roller in a transport direction of the recording medium.

That is, the fixing device according to the present invention has at least two pressure rollers providing respective nip portions by pressing the fixing roller. Note that, the fixing roller may be a heat roller having a heat source. In this case, the first pressure roller may mainly have a fixing capability of melting an unfixed developing agent on the recording medium under heat of the fixing roller and firmly adhering the developing agent onto the recording medium. Also, in this case, the second pressure roller may mainly have a peeling capability of peeling, from the heat roller, the recording medium on which the developing agent has been fixed while having been transported between the first pressure roller and the heat roller. Thus, by using the fixing device including the first pressure roller having the fixing capability and the second pressure roller having the peeling capability, it is possible to realize a preferred and excellent fixing process.

Further, a fixing device according to the present invention, in order to achieve the first object, includes: at least two pressure rollers providing respective nip portions by pressing a heat roller (fixing roller) having a heat source, wherein the heat roller and the pressure rollers rotate, thereby transporting a recording medium to the nip portions and fixing a developing agent on the recording medium, the pressure rollers at least including: a first pressure roller which provides a first nip portion by pressing the heat roller and delivers, to the first nip portion, the recording medium having been externally transported; and a second pressure roller which provides a second nip portion by pressing the heat roller and peels the recording medium having passed though the second nip portion from the heat roller, the first pressure roller being disposed upstream to the second pressure roller in a transport direction of the recording medium, wherein: there is the following relation between the heat roller, the first pressure roller, and the second pressure roller:

an outer diameter of the heat roller>an outer diameter of the first pressure roller>an outer diameter of the second pressure roller.

Thus, the first pressure roller and the second pressure roller are smaller in size than the heat roller, so that the first pressure roller and the second pressure roller can be disposed close to each other. With this arrangement, it is possible to prevent a warpage on the recording medium in an area between the first nip portion and the second nip portion, thus decreasing the occurrence of a paper jam. Further, by preventing a warpage on the recording medium, it is possible to prevent displacement of a developing agent to be fixed on the recording medium when the recording medium passes through the first nip portion and the second nip portion. Still further, the first pressure roller and the second pressure roller are smaller in size, so that it is possible to realize size reduction of the fixing device.

Further, the outer diameter of the first pressure roller is formed smaller than that of the heat roller but larger than that of the second pressure roller. Therefore, the recording medium transported to the fixing device is caught at the first nip portion. This facilitates delivery of the recording medium to the first nip portion. Still further, the second pressure roller is the smallest in outer diameter among the three rollers, so that the nip width of the second nip portion becomes narrow. Therefore, the second pressure roller with its pressure load concentrated can press the heat roller, thus peeling the recording medium in a preferred manner even with a small pressure load.

Further, smaller outer diameters of the first and second pressure rollers can decrease a time (warm-up time) and amount of electrical power required for warming up the rollers in the fixing device from a room temperature to a predetermined fixing temperature. Therefore, a fixing device of the present invention can perform a warm-up at a high speed and realize size reduction and lower power requirements, when compared with the conventional fixing device.

Therefore, an image forming apparatus of the present invention includes the foregoing fixing device, thus enabling providing an image forming apparatus that realizes size reduction and low power requirements while securing an excellent property of fixing a toner image to the recording medium.

A fixing device according to the present invention, in order to achieve the second object, includes: two pressure rollers providing respective nip portions by pressing the fixing roller, wherein the fixing roller and the pressure rollers rotate, thereby transporting a recording medium to the nip portions and fixing a developing agent on the recording medium, the pressure rollers including: a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, the first pressure roller being disposed upstream to the second pressure roller in a transport direction of the recording medium, wherein: press positions where the first and second pressure rollers press the fixing roller are set so that, in a cross section orthogonal to central axes of the fixing roller and the pressure rollers, a first orthogonal line being orthogonal to a first line that connects a center of the fixing roller and a center of the first pressure roller and passing through the first nip portion, comes into contact with a contact area in a predetermined area on a peripheral surface of the second pressure roller, and the contact area is an area between (a) an intersection position where a second orthogonal line being orthogonal to a second line that connects the center of the fixing roller and a center of the second pressure roller and passing through the center of the second pressure roller intersects with a peripheral surface of the second pressure roller on the first pressure roller's side and (b) an end part of the second nip portion upstream in the transport direction of the recording medium.

The first orthogonal line is a transport direction of the recording medium passing through the first nip portion. The intersection position is a boundary point where the leading end part of the recording medium slides over the surface of the second pressure roller toward the second nip portion under the situation where the leading end part of the recording medium comes into contact with the first pressure roller, and thereafter, the recording medium is further transported, and the second pressure roller rotates. Therefore, in the above arrangement, the positions where the first pressure roller and the second pressure roller are disposed are set so that the first orthogonal line comes into contact with a contact area in the foregoing area.

With this arrangement, the recording medium cannot be transported in intimate contact with the fixing roller in an area between the first nip portion and the second nip portion. When the recording medium comes into contact with the surface of the second pressure roller, the leading end part of the recording medium comes into contact with the foregoing contact area, so that it is possible to transport the recording medium to the second nip portion in an excellent manner. Therefore, it is possible to transport the recording medium in a preferred manner while preventing the occurrence of a paper jam in an area between the first nip portion and the second nip portion.

Further, an image forming apparatus according to the present invention includes the foregoing fixing device, so that it is possible to transport the recording medium from the first nip portion to the second nip portion in a preferred manner while preventing the occurrence of a paper jam in the fixing device, when the recording medium, such as a piece of recording paper and plural pieces of recording paper stacked, is transported.

Further, outer diameters of the two pressure rollers included in the fixing device are made smaller than an outer diameter of the fixing roller, so that it is possible to realize size reduction and lower power requirements of the fixing device. Therefore, it is possible to provide an image forming apparatus which realizes size reduction and low power requirements.

For a fuller understanding of the nature and advantages of the invention, reference should be made to the ensuing detailed description taken in conjunction with the accompanying drawings.

DESCRIPTION OF THE EMBODIMENTS

The following will describe one embodiment of the present invention with reference to drawings.

Figure 1:
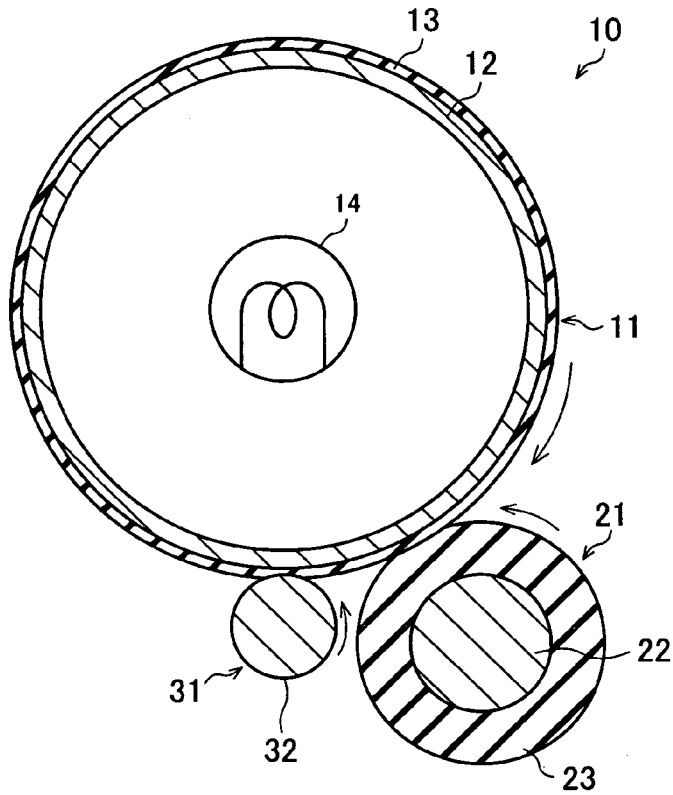
FIG. 1 is a cross-sectional diagram schematically illustrating one embodiment of a fixing device in the present invention.

FIG. 1 is a cross-sectional diagram schematically illustrating a fixing device 10 of the present embodiment. The fixing device 10, which is included in an electrophotographic printer (image forming apparatus), for example, melts an unfixed toner image made up of an unfixed toner (developing agent) on a recording paper (recording medium) and firmly adheres it onto the recording-paper. That is, the fixing device 10 includes a cylindrical heat roller 11, a cylindrical pressure roller (first pressure roller) 21, and a cylindrical peeling roller (second pressure roller) 31, and catches and carries the recording paper between these rollers, thereby fixing toner images on the recording paper under heat and pressure.

Thus, the fixing device 10 is provided with the pressure roller 21 and the peeling roller 31 both of which press the heat roller 11. Therefore, in the fixing device 10, as illustrated in FIG. 1, the recording paper is brought into contact with a surface of the heat roller 11 at a nip portion (hereinafter referred to as "first nip portion") where the heat roller 11 and the pressure roller 21 are in contact with each other. Then, the recording paper in contact with the surface of the heat roller 11 is transported to another nip portion (hereinafter referred to as "second nip portion") where the heat roller 11 and the peeling roller 31 are in contact with each other, along a direction in which the heat roller 11 rotates.

That is, the fixing device 10 has an apparent nip portion (hereinafter referred to as "virtual nip portion" that is an area from the first nip portion to the second nip portion along the direction in which the heat roller 11 rotates, wherein a heat is given and received from the heat roller 11. As will be described later, even when the heat roller 11 with its thickness reduced is used, this arrangement therefore ensures an adequate nip width without increase in nip pressure of the pressure roller 21 and the peeling roller 31, thus ensuring an excellent fixing property.

Further, at the second nip portion, the peeling roller 31 peels the recording paper, which ensures an excellent peeling property with respect to the recording paper even when the recording paper is transported along the heat roller 11 between the first nip portion and the second nip portion.

Note that, the fixing device 10 includes three rollers. However, the fixing device 10 may be arranged so as to include four or more rollers. In the arrangement of four or more rollers, there are one peeling roller and three or more pressure rollers. Thus, three or more pressure rollers can increase the length of a time during which the recording paper and the heat roller are in contact with each other and expand the range where the recording paper and the heat roller are in contact with each other. Therefore, even when the recording paper is transported at high speed, it is possible to sufficiently heat the recording paper for an ensured melting of an unfixed toner image. The following will detail the elements in the fixing device 10.

The heat roller 11 is a heat source for melting a toner on the recording paper, and a toner image on the recording paper is fixed under pressure applied by the heat roller 11, the pressure roller 21, and the peeling roller 31. The heat roller 11 rotates in a direction indicated by an arrow in FIG. 1 under a drive force from a drive source (not shown).

The heat roller 11 is, for example, a roller with an outer diameter ϕ of about 40 mm, for example, having a metal cylinder 12 made of metal such as aluminum or iron, a heating-side elastic layer (heat-roller-side elastic layer) 13 made of silicone rubber around the metal cylinder 12, and a releasing layer (not shown) formed on a surface of the heating-side elastic layer 13. The metal cylinder 12 is hollow and provided with a heater 14 as a heat source therein. The heater 14 heats the metal cylinder 12 and the heating-side elastic layer 13 of the heat roller 11.

The metal cylinder 12 of the heat roller 11 is a heat accumulation section for accumulating heat generated from the heater 14. The metal cylinder 12 is preferably 3 mm or less in thickness for its reduction of heat capacity and the amount of heat released. Specifically, when the metal cylinder 12 is made of aluminum, the metal cylinder 12 is preferably a thin-walled cylinder of 1 mm to 3 mm in thickness. When the metal cylinder 12 is made of iron, the metal cylinder 12 is preferably a thin-walled cylinder of 0.25 mm to 1.0 mm in thickness. Thus, the heat roller 11 includes the thin-walled metal cylinder 12, so that a heat capacity and the amount of heat released of the heat accumulation section can be reduced. This makes it possible to reduce a warm-up time of the heat roller 11 that is required for heating the heat roller 11 from room temperature to a predetermined fixing temperature and to reduce the amount of electrical power required for a warm-up of the heat roller 11. Moreover, it is possible to facilitate holding a temperature of the heat roller constant.

Further, the heating-side elastic layer 13 may be made of material other than silicone rubber. Specifically, the heating-side elastic layer 13 should be made of elastic material having a hardness of the order of 26 (hardness specified by an ASKER-C hardness meter), such as fluoro rubber. The heating-side elastic layer 13 is preferably excellent in thermal conductivity for a preferred fixing of a toner image on a recording paper under heat and pressure. Here, the heating-side elastic layer 13 is preferably 3 mm or less in thickness and is more preferably 1 mm or less in thickness.

That is, increase in thickness of the heating-side elastic layer 13 increases difference in temperature between the inner surface of the heating-side elastic layer 13, a part where the heating-side elastic layer 13 is connected to the metal cylinder 12, and the perimeter of the heating-side elastic layer 13, the outer surface of the heating-side elastic layer 13. Such a great difference in temperature between the inner surface and the perimeter of the heating-side elastic layer 13 is not preferable in terms of durability of the heating-side elastic layer 13, so that the metal cylinder 12 must be further heated for a rise in temperature of the metal cylinder 12. However, a rise in temperature of the metal cylinder 12 causes a rise in temperature of the heating-side elastic layer 13, resulting in deterioration of the heating-side elastic layer 13 caused by heat history and increase in hardness of the heating-side elastic layer 13. Furthermore, a rise in temperature of the metal cylinder 12 increases the amount of heat given and received from the metal cylinder 12 to the heating-side elastic layer 13 and slows down a rise in temperature of the surface of the heat roller 11, resulting in increase of warm-up time. Therefore, as described previously, the heating-side elastic layer 13 is preferably 3 mm or less in thickness and is more preferably 1 mm or less in thickness.

For a favorable durability of the heating-side elastic layer 13, change in hardness caused by heating of the heating-side elastic layer 13, and warm-up time of the fixing device, the heating-side elastic layer 13 preferably has a hardness of the order of 26 (hardness specified by an ASKER-C hardness meter). This makes it possible to prevent deterioration of the heating-side elastic layer 13 caused by heat history, to prevent increase of a warm-up time, and to sufficiently heat a toner, for an excellent toner-image fixing.

Further, the heat roller 11 make elastic deformation according to an uneven toner image on the recording paper, so that it is possible to sufficiently melt a toner even when adjacent toners of various colors are overlapping in color printing, for example. This enables an excellent fixing on the recording paper. Furthermore, thanks to provision of the heating-side elastic layer 13, the heat roller 11 hollows its shape at the nip portions, thus improving an easiness of peeling of a melted toner from the surface of the heat roller 11.

The heat roller 11 directly comes into contact with a toner on the recording paper. In view of this, the heat roller 11 is provided with a releasing layer that enhances a releasing property with respect to a toner so as to prevent the toner from adhering to the heat roller 11. The releasing layer is preferably made of material having a releasing property and a heat resistance. For example, such a material can be fluorine-based resin such as PFA (perfluoroalkoxytetrafluoroethylene copolymer) or polytetrafluoroethylene (PTFE). The releasing layer is preferably 10 μm to 50 μm in thickness to ensure excellent releasing property, durability, and thermal conductivity. In the present embodiment, the heating-side elastic layer 13 is covered with a PFA tube of 30 μm in thickness.

Further, the heater 14 can be anything that heats the metal cylinder 12 and the heating-side elastic layer 13 of the heat roller 11. For example, the heater 14 may be a halogen lamp, ceramic heater, or the like.

Further, the pressure roller 21 presses the heat roller 11 and applies pressure to a recording paper carrying an unfixed toner image, the recording paper passing between the pressure roller 21 and the heat roller 11, so as to fix the toner image on the recording paper. The pressure roller 21 presses the heat roller 11 with a predetermined push force (pressure load) by means of a pressure spring (not shown). The pressure roller 21, while pressing the heat roller 11, rotates with rotation of the heat roller 11 in a direction indicated by an arrow in FIG. 1.

The pressure roller 21 includes a shaft 22 that is a cylinder rotating body made of metal such as stainless or iron (hereinafter referred to as "pressure application-side shaft 22"), a pressure application-side elastic layer (first pressure-roller-side elastic layer) 23 made of rubber, sponge, or other material, provided on the surface of the pressure-application-side shaft 22, and a releasing layer (not shown) covering the surface of the pressure-application-side elastic layer 23.

The pressure-application-side elastic layer 23 can be formed of a rubber material such as silicone rubber or a foaming sponge such as a silicone-based sponge that is realized by foaming silicone rubber, having a hardness of the order of 26 (hardness specified by an ASKER-C hardness meter). The pressure-application-side elastic layer 23 is preferably formed of elastic material that is the same material as that of the heating-side elastic layer 13.

The pressure roller 21 preferably has an outer diameter as small as possible for realization of a size-reduced fixing device. Here, especially in the case where a large amount of toner is put on a recording paper in a printing like color printing, heat must be passed in a large area so as to melt a toner. Further, an adequate fixing temperature and fixing time allows for improvement in glossiness on the surface of the recording paper having the toner image fixed thereto. Further, the pressure roller 21 requires an outer diameter of a predetermined size to catch a leading end part of the recording paper (externally) transported via a transfer roller of a printer which will be described later, and then nip the leading end part at the first nip portion where the heat roller 11 and the pressure roller 21 are in contact with each other. In other words, the pressure roller 21 must secure an outer diameter of a predetermined size so that no paper jam and other troubles occur when the leading end part of the recording paper transported strikes the pressure roller 21.

A nip width of the first nip portion can be secured by providing the pressure-application-side elastic layer 23 to the pressure roller 21. That is, when the heat roller 11 and the pressure roller 21 press each other, the pressure-application-side elastic layer 23 makes elastic deformation, whereby a transport force that transports a recording paper can be secured. Therefore, in view of a nip width secured by the pressure-application-side elastic layer 23 and a secured catching of the leading end part of the recording paper, the pressure roller 21 preferably has an outer diameter $\phi$ smaller than that of the heat roller 11 but larger than that of the peeling roller 31. Normally, the pressure roller 21 preferably has an outer diameter of the order of 10 mm to 25 mm. More specifically, the pressure roller 21 should be formed by providing the pressure-application-side elastic layer 23 having a thickness of 2 mm around the pressure-application-side shaft 22 having an outer diameter of 14 mm.

When the above-arranged pressure roller 21 is used to press the heat roller 11 with a pressure application force of 5 kg·f, a nip having a width of the order of 3 mm can be secured at the first nip portion where the heat roller 11 and the pressure roller 21 are pressed each other.

Figure 2:
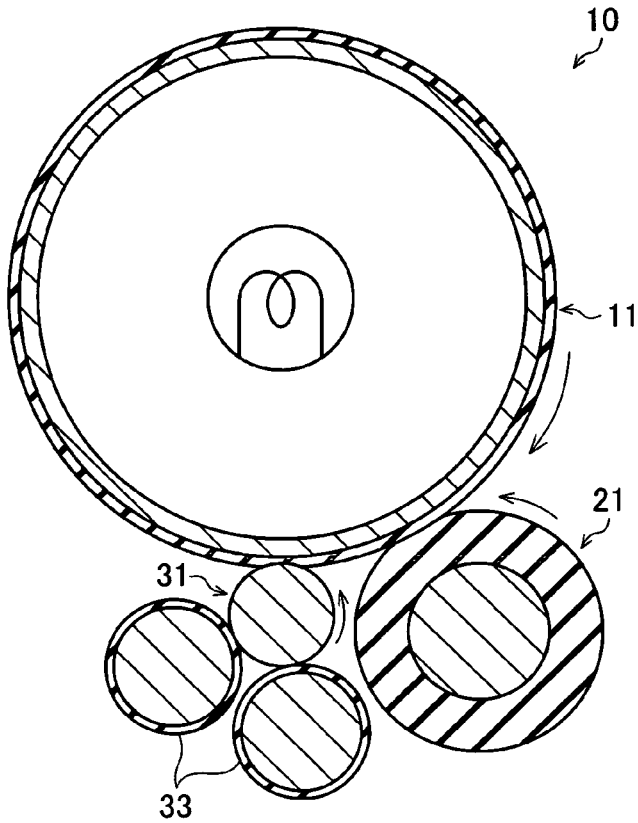
FIG. 2 is a cross-sectional diagram schematically illustrating an arrangement in which backup members are provided to a peeling roller in the fixing device.

Further, FIG. 2 is a cross-sectional diagram schematically illustrating the fixing device 10 when backup members 33 which come into contact with the peeling roller 31 are provided. Thanks to the backup members 33 illustrated in FIG. 2, the peeling roller 31 is pushed and pressed to the heat roller 11 with a predetermined push force (pressure load). The backup members 33 are provided to prevent a warpage that occurs in a rotation axis direction of the peeling roller 31 and to equalize the pressure of the pealing roller 31 with respect to the heat roller 11 in the rotation axis direction of the peeling roller 31. The backup members cause the peeling roller 31 in a state of being pressed to the heat roller 11 to rotate under a drive of a drive source such as a gear (not shown) in a direction indicated by an arrow in FIG. 1. Alternatively, it may be arranged such that the backup members cause the peeling roller 31 in a state of being pressed to the heat roller 11 to rotate with the rotation of the heat roller 11 in a direction indicated by the arrow in FIG. 1.

With this arrangement, when the recording paper passes between the peeling roller 31 and the heat roller 11, the peeling roller 31 pushes a melted unfixed toner into an uneven surface of the recording paper so that the melted unfixed toner image comes into the uneven surface of the recording paper, and flattens and completely fixes a toner image on the recording paper. Further, the peeling roller 31 peels the recording paper passing through the second nip portion where the heat roller 11 and the peeling roller 31 are in contact with each other, without winding the recording paper around the heat roller 11.

The peeling roller 31 may be a cylindrical shaft 32 made of metal (hereinafter referred to as "peeling-side shaft 32") or may be realized by covering the cylindrical shaft 32 with a peeling-side elastic layer (not shown) (second pressure-roller-side elastic layer) formed of an elastic material that is the same as that of the heating-side elastic layer 13. Here, the peeling-side elastic layer is preferably formed of an elastic material that is the same as that of the heating-side elastic layer 13 or formed of an elastic material such as a rubber which is harder than the heating-side elastic layer 13. This makes it possible to enhance a peeling property with respect to the recording paper.

That is, if the peeling-side elastic layer is formed of an elastic material that is the same as that of the heating-side elastic layer 13, the peeling-side elastic layer and the heating-side elastic layer 13 make elastic deformations at the second nip portion. Therefore, the second nip portion becomes linear at a cross section orthogonal to central axes of the heat roller 11, the pressure roller 21, and the peeling roller 31, illustrated in FIG. 1. Therefore, the recording paper linearly passes through the second nip portion, so that the recording paper can be easily peeled from the heat roller 11 and the peeling roller 31.

Further, if the peeling-side elastic layer is formed of an elastic material which is harder than the heating-side elastic layer 13, the peeling roller 31 hollows the surface of the heat roller 11 at the second nip portion, which elastically deforms the heating-side elastic layer 13 (the surface of the heating-side elastic layer 13) of the heat roller 11. With this arrangement, the recording paper passing through the second nip portion is transported along the peeling roller 31, so that the recording paper can be peeled in a preferred manner.

The peeling roller 31 has an outer diameter smaller than outer diameters of the heat roller 11 and the pressure roller 21 (For example, the peeling roller 31 has an outer diameter of 15 mm or less.), and the peeling roller 31 has preferably an outer diameter of 8 mm or more. Further, the peeling roller 31 has more preferably an outer diameter of 8 mm to 10 mm. Therefore, the nip width of the second nip portion can be decreased to the order of 1 mm to 2 mm, so that a load of the peeling roller 31 can be concentrated to the heat roller 11. This can secure a pressure for completely fixing a melted unfixed toner image and a pressure for peeling the recording paper. Moreover, provision of the peeling roller 31 having a small outer diameter realizes size reduction of the fixing device.

Note that, for realization of reduction in warm-up time of the fixing device 10 and reduction in the amount of electrical power required for warm-up of the fixing device 10, the fixing device 10 may be arranged such that the peeling-side shaft 32 is hollow so that a heat capacity of the peeling roller 31 can be reduced.

In the fixing device 10 including the above-arranged heat roller 11, pressure roller 21, and peeling roller 31, as illustrated in FIG. 1, the pressure roller 21 and the peeling roller 31 are disposed in such a manner so as to press the heat roller 11. Further, the heat roller 11, the pressure roller 21, and the peeling roller 31 are disposed in such a manner that their respective central axes are parallel to one another. In the fixing device 10, the pressure roller 21 is disposed at the upstream end to a transport direction of the recording paper, and the peeling roller 31 is disposed at the downstream end to the transport direction of the recording paper. More preferably, the pressure roller 21 is disposed at the most upstream end to the transport direction of the recording paper, and the peeling roller 31 is disposed at the most downstream end to the transport direction of the recording paper.

Further, the pressure roller 21 and the peeling roller 31 are preferably disposed close in such a manner that they are not in contact with each other and the recording paper can be transported in a preferred manner from the first nip portion to the second nip portion. Specifically, a distance between the periphery of the pressure roller 21 and the periphery of the peeling roller 31 is 1 mm or less when the pressure roller 21 and the peeling roller 31 come closest to each other. Further, the outer diameters of the heat roller 11, the pressure roller 21, and the peeling roller 31 have the following relation: the outer diameter of the heat roller 11> the outer diameter of the pressure roller 21> the outer diameter of the peeling roller 31. That is, their outer diameters decrease in the following order: the heat roller 11, the pressure roller 21, and the peeling roller 31.

Thus, in the fixing device 10, the rollers satisfy the above relation, and the pressure roller 21 and the peeling roller 31 are disposed close in such a manner that a distance between them is as small as possible. With this arrangement, the pressure roller 21 fixes an unfixed toner image in an excellent manner and the peeling roller 31 peels the recording paper in an excellent manner, so that it is possible to prevent the occurrence of a paper jam in the fixing device 10.

That is, in the fixing device 10, as illustrated in FIG. 1, for an excellent transport of the recording paper in the rotation direction of the heat roller 11 between the first nip portion where the heat roller 11 and the pressure roller 21 are in contact with each other and the second nip portion where the heat roller 11 and the peeling roller 31 are in contact with each other, positions where the pressure roller 21 and the peeling roller 31 are disposed are set. In other words, in the case where a fixing device, like the fixing device 10, includes three rollers, the leading end part of the recording paper having passed through the first nip portion must be securely transported to the second nip portion. If the recording paper is not transported from the first nip portion to the second nip portion in an excellent manner, a paper jam occurs between the first nip portion and the second nip portion. In view of this, it is desirable that the pressure roller 21 and the peeling roller 31 are disposed so as to realize an excellent transport of the recording paper between the first nip portion and the second nip portion.

Further, by causing the outer diameters of the respective rollers to satisfy the above relation, it is possible to reduce a time required for warm-up for heating the rollers in the fixing device from room temperature to a predetermined fixing temperature and to reduce the amount of electrical power required for the heating. Still further, since the pressure roller 21 and the peeling roller 31 are as small as possible, it is possible to reduce a size of the fixing device 10.

Figure 3:
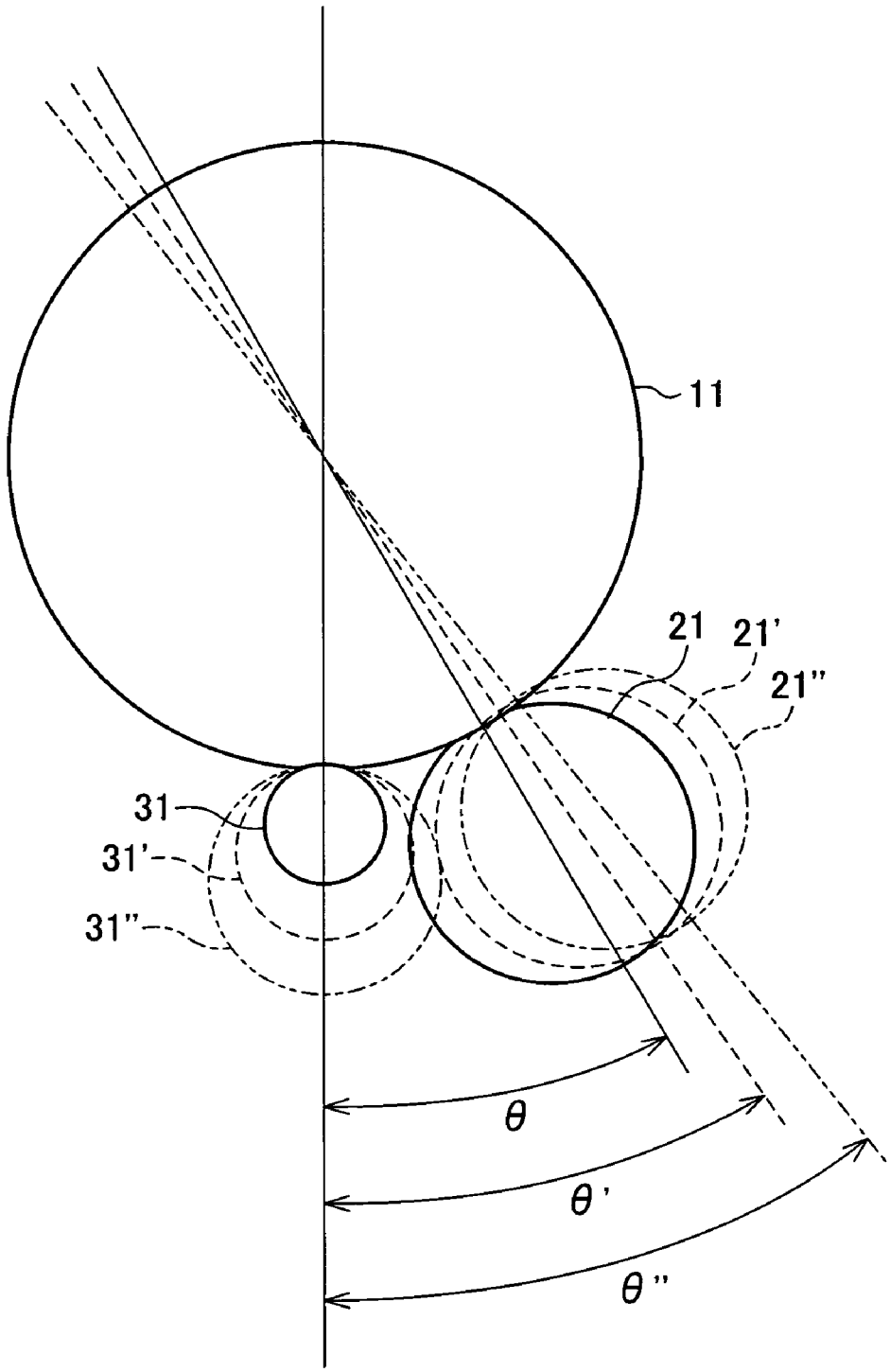
FIG. 3 is a cross-sectional diagram schematically illustrating a position where a pressure roller is disposed, varying depending on an outer diameter of the peeling roller.

Note that, positions where the pressure roller 21 and the peeling roller 31 are disposed vary depending on outer diameters of the respective rollers. FIG. 3 is a cross-sectional diagram illustrating a position where the pressure roller 21 is disposed varying depending on an outer diameter of the peeling roller 31. As illustrated in FIG. 3, as the outer diameter of the peeling roller 31 increases in the following order: 31, 31', and 31", the position where the pressure roller 21 is disposed varies in the following order: 21, 21', and 21". Therefore, as the outer diameter of the peeling roller 31 increases, an angle which a line connecting the centers of the heat roller 11 and the peeling roller 31 forms with a line connecting the centers of the heat roller 11 and the pressure roller 21 increases in the following order: θ, θ', and θ". That is, a distance between the central axis of the pressure roller 21 and the central axis of the peeling roller 31 on the periphery of the heat roller 11 increases. This tendency also occurs in the same manner when the outer diameter of the pressure roller 21 is varied.

Therefore, it is preferable that the positions where the pressure roller 21 and the peeling roller 31 are disposed must be set such that a leading end part of the recording paper having passed through the first nip portion is transported to the second nip portion.

For this, regardless of sizes of the respective rollers included in the fixing device 10, to realize an excellent transport of the recording paper from the first nip portion to the second nip portion, it is preferred that the positions where the pressure roller 21 and the peeling roller 31 are disposed are set as follows. The following will detail the positions where the pressure roller 21 and the peeling roller 31 are disposed with reference to drawings.

Figure 4:
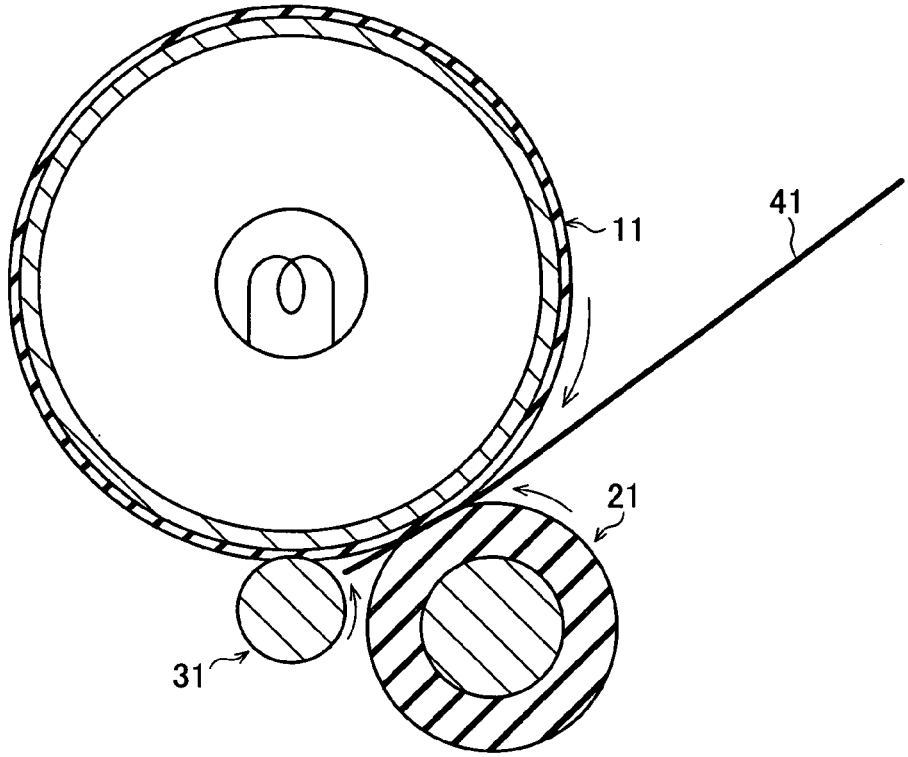
FIGS. 4(*a*) and 4(*b*) are cross-sectional diagrams schematically illustrating the movement of a recording paper in the fixing device arranged such that the pressure roller and the peeling roller are disposed close to each other.
Figure 4:
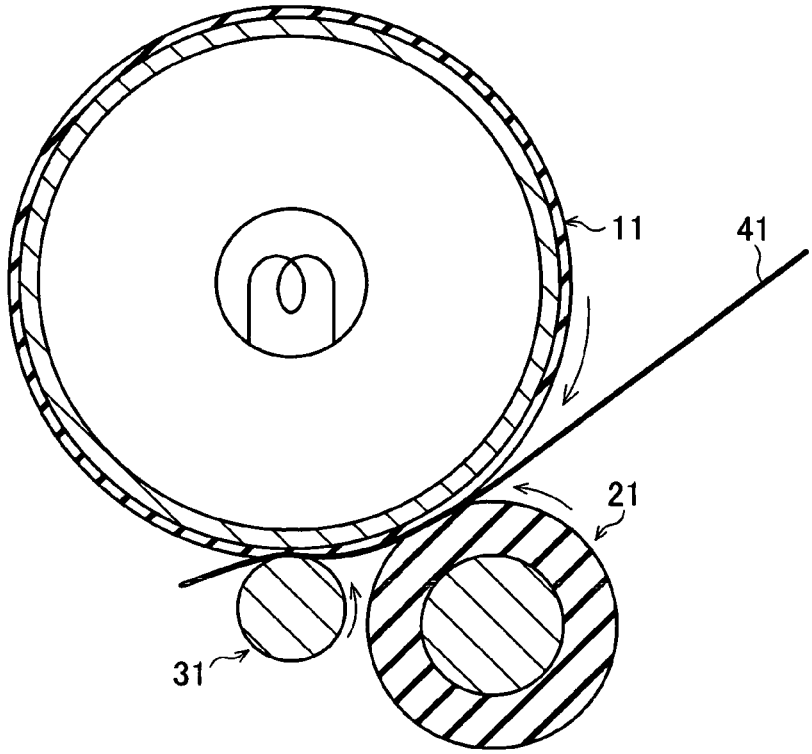
Figure 5:
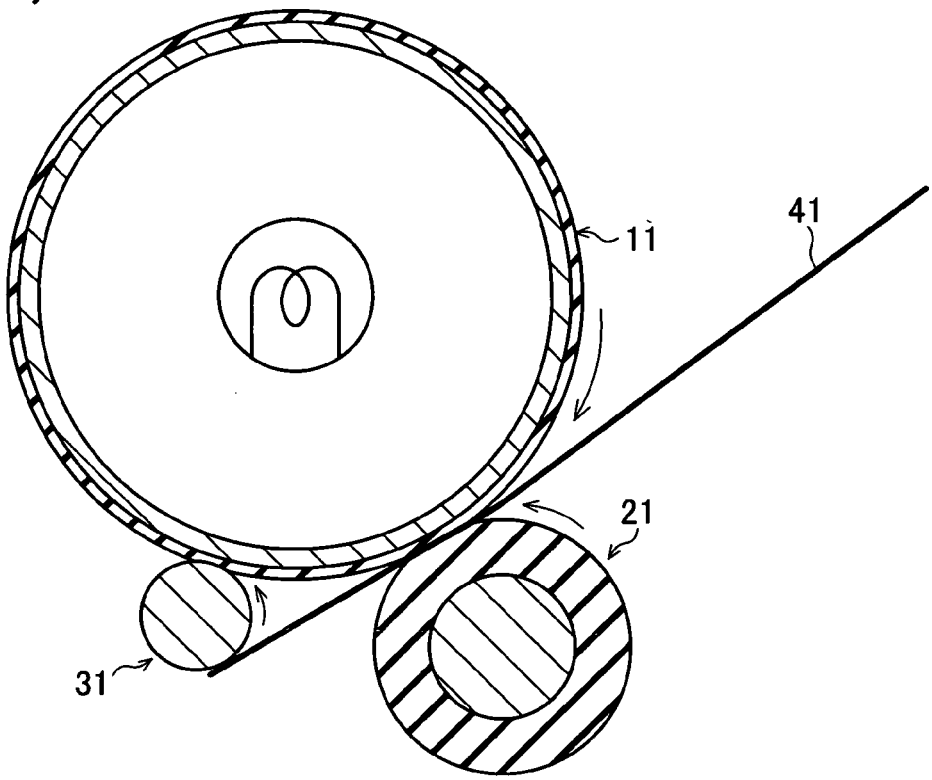
FIGS. 5(*a*) and 5(*b*) are cross-sectional diagrams schematically illustrating the movement of a recording paper in the fixing device arranged such that the pressure roller and the peeling roller are disposed away from each other.
Figure 5:
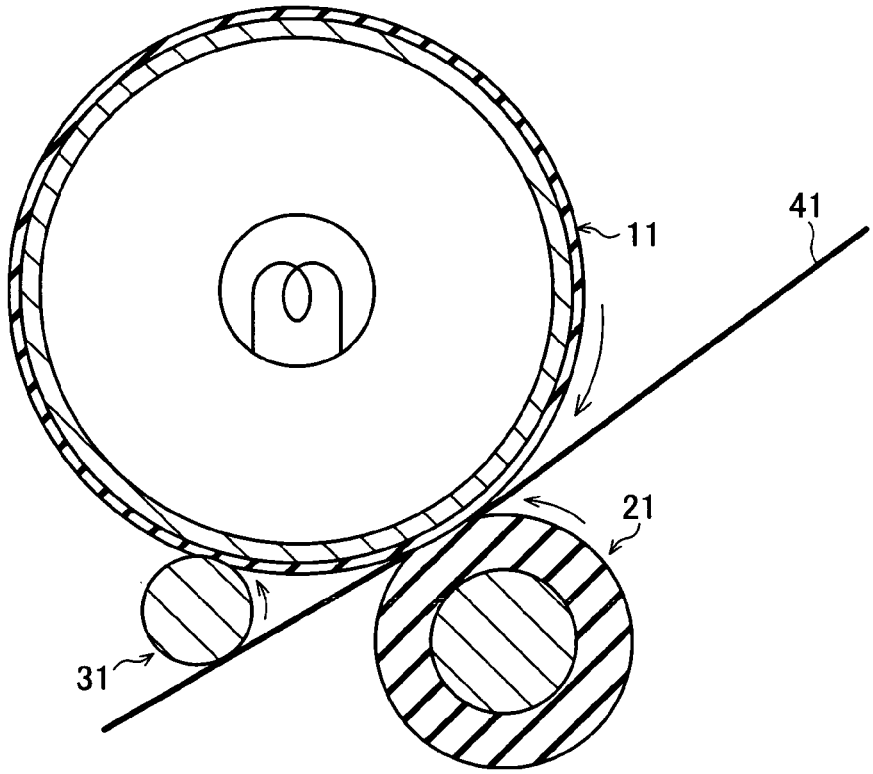
Figure 6A:
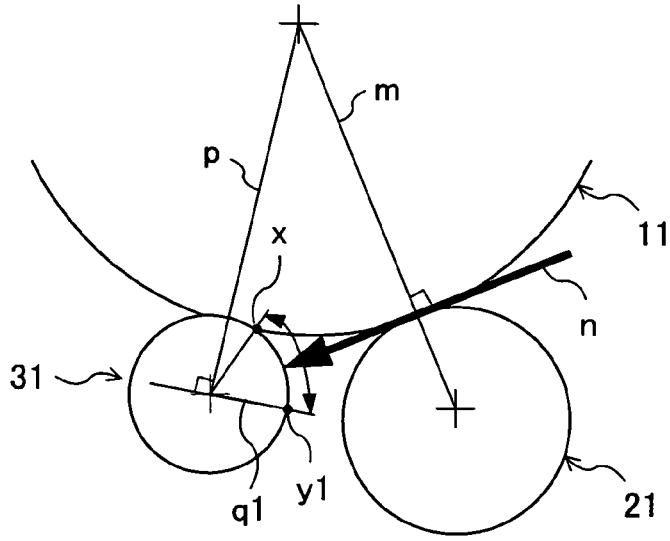
FIGS. 6(*a*)–6(*c*) are cross-sectional diagrams schematically illustrating positions of the pressure roller and the peeling roller in the fixing device.
Figure 6B:
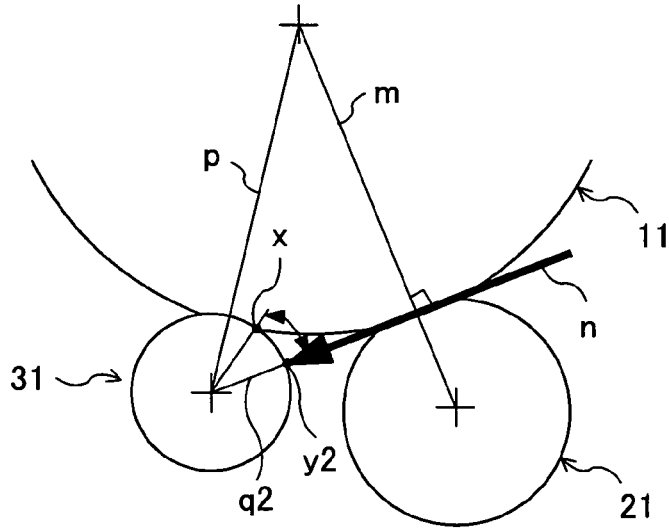
Figure 6C:
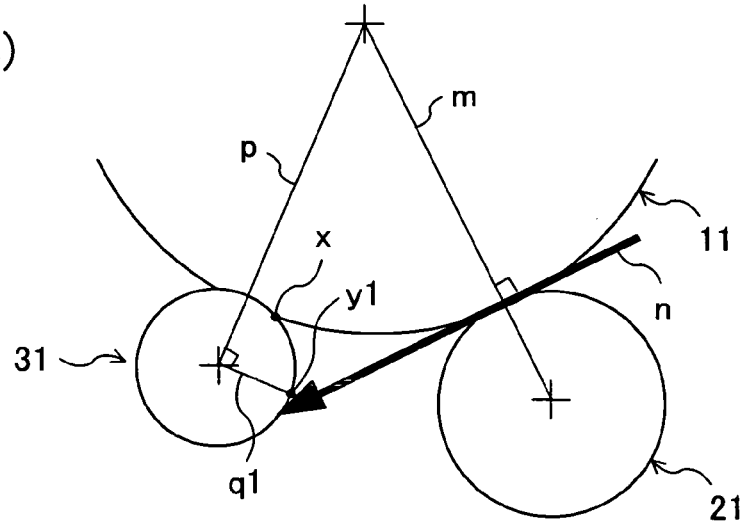

FIGS. 4(*a*) and 4(*b*) and FIGS. 5(*a*) and 5(*b*) are cross-sectional diagrams schematically illustrating movements of a recording paper according to the positions of the placement of the heat roller 11, the pressure roller 11, and the peeling roller 31. FIGS. 6(*a*) through 6(*c*) are cross-sectional diagrams schematically illustrating the positions of the heat roller 11, the pressure roller 21, and the peeling roller 31. These drawings illustrate cross sections of the heat roller 11, the pressure roller 21, and the peeling roller 31 which are orthogonal to their respective central axes when they are disposed in such a manner that their central axes are parallel to one another.

As illustrated in FIGS. 4(*a*) and 4(*b*) and FIGS. 5(*a*) and 5(*b*), a transport direction of a recording paper 41 after passing through the first nip portion varies depending on the positions of the heat roller 11, the pressure roller 21, and the peeling roller 31. That is, as illustrated in FIGS. 4(*a*) and 4(*b*), when a leading end part of the recording paper 41 comes into contact with the peeling roller 31 on a peripheral surface closer to the second nip portion, the recording paper 41 is transported to the second nip portion. Details will be described later.

On the other hand, as illustrated in FIGS. 5(*a*) and 5(*b*), when the leading end part of the recording paper 41 comes into contact with the peeling roller 31 on a peripheral surface far from the second nip portion, the recording paper 41 is less prone to being transported to the second nip portion. That is, as illustrated in FIG. 5(*a*), when the leading end part of the recording paper 41 after passing through the first nip portion comes into contact with the peeling roller 31, the leading end part of the recording paper 41 is not transported to the second nip portion. Instead, the leading end part of the recording paper 41 is transported to a position where it does not come into contact with the heat roller 11, as illustrated in FIG. 5(*b*), thus resulting in the occurrence of a paper jam.

In view of this, the fixing device 10 determines the positions where the pressure roller 21 and the peeling roller 31 are disposed in such a manner that in the cross sections illustrated in FIG. 6(*a*), a line (first orthogonal line) n (an arrow n in FIG. 6(*a*)) orthogonal to a line (first line) m that connects the center of the heat roller 11 (a point indicated by a plus (+) in FIG. 6(*a*)) and the center of the pressure roller 21 (a point indicated by a plus (+) in FIG. 6(*a*)), and passing through the first nip portion comes into contact with an area (contact area) in a predetermined area on the periphery of the peeling roller 31. Here, the line n corresponds to a transport direction of a recording paper.

More specifically, as illustrated in FIG. 6(*a*), the pressure roller 21 and the peeling roller 31 are disposed in such a manner that the line n that is the transport direction of the recording paper comes into contact with the peripheral surface of the peeling roller 31 in an area between a point x and a point y1 (an area indicated by a double-headed arrow in FIG. 6(*a*); hereinafter referred to as "x-y1 area"). Here, the point x is an end part of the second nip portion at the upstream end on the peripheral surface of the peeling roller 31 to the transport direction of the recording paper, i.e. an end part of the second nip portion on the pressure roller 21's side. The point y1 is a position (intersection position) where a line (second orthogonal line) q1 orthogonal to a line (second line) p that connects the centers of the heat roller 11 and the peeling roller 31 (points indicated by pluses (+) in FIG. 6(*a*)) and passing through the center of the peeling roller 31 intersects with the peripheral surface of the peeling roller 31 on the pressure roller 21's side.

The point y1 is a position which is closest to the pressure roller 21 on the periphery of the peeling roller 31. Accordingly, it is considered that this point y1 is a boundary between the upstream side and the downstream side on which the recording paper is transported in the rotation direction of the peeling roller 31. Therefore, for a more reliable transport of the recording paper on the downstream side with respect to the point y1, it is preferable to dispose the pressure roller 21 and the peeling roller 31 with respect to the heat roller 11 in such a manner that the arrow n comes into contact with the x-y1 area.

When the pressure roller 21 and the peeling roller 31 are disposed so as to satisfy the foregoing relation, the leading end part of the recording paper having passed through the first nip portion illustrated in FIG. 4(*a*) can come into contact with the x-y1 area. This makes it secure that the recording paper 41 is transported by the pressure roller 21 and is then transported to the second nip portion by rotation of the peeling roller 31, as illustrated in FIGS. 4(*a*) and 4(*b*). That is, in addition to transport of the recording paper 41, there occurs a sliding phenomenon in which the leading end part of the recording paper 41 slides over the surface of the peeling roller 31 to the second nip portion side. Further, rotation of the peeling roller 31 transports the leading end part of the recording paper 41 in contact with the x-y1 area, to the second nip portion side. Therefore, owing to the sliding phenomenon and rotation of the peeling roller 31, the recording paper 41 is transported to the second nip portion, as illustrated in FIG. 4(*b*).

Note that, FIG. 6(*b*) illustrates particularly preferable positions of the pressure roller 21 and the peeling roller 31 where the line n comes into contact with the x-y1 area of the peeling roller 31 illustrated in FIG. 6(*a*). That is, for a more preferred transport of the recording paper from the first nip portion to the second nip portion, as illustrated in FIG. 6(*b*), it is preferable that positions where the pressure roller 21 and the peeling roller 31 are disposed are preferably set in such a manner that the line n comes into contact with the peripheral surface of the peeling roller 31 in an area between the point x and a point y2 (described later) (an area indicated by a double-headed arrow in FIG. 6(*b*); hereinafter referred to as "x-y2 area"). Here, the point y2 is a position where a line q2 extending from the line n toward the peeling roller 31's side, when passing through the center of the peeling roller 31, intersects with the peripheral surface of the peeling roller 31 on the pressure roller 21's side. That is, the line n and the line q2 form the same line.

Thus, when the leading end part of the recording paper comes into contact with the x-y2 area, the recording paper is easily transported to the second nip portion owing to the above-described sliding phenomenon. Meanwhile, when the leading end part of the recording paper comes into contact with an area other than the x-y2 area in the x-y1 area, as described previously, the recording paper is transported to the second nip portion owing to the sliding phenomenon and rotation of the peeling roller 31. In this case, it is preferable that a rotation speed of the peeling roller 31 is substantially the same as a transport speed of the recording paper or higher than the transport speed of the recording paper. Here, the transport speed of the recording paper is substantially determined in accordance with a rotation speed of the pressure roller 21.

On the contrary, as illustrated in FIG. 6(*c*), when the line n that is the transport direction of the recording paper comes into contact with an area other than the x-y1 area on the peeling roller 31, it is difficult to transport to the second nip portion the leading end part of the recording paper 41 having passed through the first nip portion (FIGS. 5(*a*) and 5(*b*)). That is, when the pressure roller 21 and the peeling roller 31 are disposed in such a manner that the line n comes into contact with an area other than the x-y1 area on the peeling roller 31 (FIG. 6(*c*)), the foregoing sliding phenomenon does not occur. Accordingly, even when the peeling roller 31 rotates, the recording paper 41 having passed through the first nip portion is not transported to the second nip portion, as illustrated in FIGS. 5(*a*) and 5(*b*).

Therefore, when the recording paper 41 comes into contact with an area other than the x-y1 area on the peeling roller 31 (FIG. 5(*a*)), as illustrated in FIG. 5(*b*), the recording paper 41 is not transported to the second nip portion. For example, instead, the recording paper 41 slips between the peeling roller 31 and the pressure roller 21. Thus, when the recording paper 41 is transported to a position other than the second nip portion, a paper jam occurs. Therefore, it is not preferable that the pressure roller 21 and the peeling roller 31 are disposed in such a manner that the line n illustrated in FIG. 6(*c*) comes into contact with an area other than the x-y1 area on the peeling roller 31.

As described above, the fixing device 10 controls the positions where the pressure roller 21 and the peeling roller 31 are disposed so that the recording paper comes into contact with the x-y1 area on the surface of the peeling roller 31. With this arrangement, the recording paper is not transported in the state of coming into intimate contact with the heat roller 11 between the first nip portion and the second nip portion, thus decreasing the occurrence of a paper jam even when the recording paper comes into contact with the surface of the peeling roller 31.

Further, a pressure load of the pressure roller 21 which presses the heat roller 11 is lower than that of the peeling roller 31 which presses the heat roller 11. Specifically, the pressure load of the pressure roller 21 which presses the heat roller 11 is on the order of 5 kg·f, for example. The pressure load of the peeling roller 31 which presses the heat roller 11 is on the order of 15 kg·f, for example. This makes it possible to flatten a sufficiently melted toner through the first nip portion and an area between the first nip portion and the second nip portion and to fix the toner on the recording paper. Further, the pressure load at the second nip portion is sufficiently secured, so that it is possible to peel the recording paper in a preferred manner.

With the above-arranged fixing device 10, fixing of an unfixed toner image on a recording paper under heat and pressure is carried out as follows: when a recording paper carrying an unfixed toner image, passing through a transfer roller of a printer (described later) is transferred in such a manner that an unfixed toner and the heat roller 11 are in contact with each other, the heat roller 11, the pressure roller 21, and the peeling roller 31 rotate under a drive force given from a drive source (not shown) in the respective directions indicated by arrows in FIG. 1. With this arrangement, the recording paper is transported through the first nip portion, a toner is melted, and the toner melted at the second nip portion is completely fixed on the recording paper. Thereafter, the recording paper is peeled from the heat roller 11 and is ejected from the fixing device 10. This is the end of a fixing process. The following will detail the fixing process.

That is, when the recording paper carrying the unfixed toner image is transported, the heat roller 11, the pressure roller 21, and the peeling roller 31 rotate. In the present case, a rotation speed (circumferential velocity) of the heat roller 11 should be set in accordance with a process speed of the image forming apparatus.

For example, like the present embodiment, if the pressure roller 21 rotates with rotation of the heat roller 11 and the peeling roller 31 is driven by a drive source different from the drive source of the heat roller 11, or if the heat roller 11, the pressure roller 21, and the peeling roller 31 are driven by respective drive sources, it is preferable that a rotation speed V1 of the pressure roller 21 is lower than or equal to a rotation speed V2 of the peeling roller 31. In other words, it is preferable that rotation speed of the pressure roller 21 is equal to rotation speed of the peeling roller 31 or is slower than a rotation speed of the peeling roller 31.

If the rotation speed V2 of the peeling roller 31 is higher than the rotation speed V1 of the pressure roller 21, the rotation speed V2 of the peeling roller 31 is preferably set, with respect to the rotation speed V1 of the pressure roller 21, to fall within the following range: $V1 \times 1.0 \leqq V2 \leqq V1 \times 1.1$.

This is because, due to expansion of the transported recording paper under heat at the first nip portion, there might occur a slack in the recording paper transported between the first nip portion and the second nip portion. The slack occurring in the recording paper transported between the first nip portion and the second nip portion becomes a cause of a displaced fixing of a toner image on the recording paper. In view of this, rotation speeds of the pressure roller 21 and the peeling roller 31 are set so as to fall within the above range, thus preventing a slack in the recording paper and ensuring an excellent fixing property without a displaced fixing.

Note that, to make the rotation speed of the pressure roller 21 equal to that of the peeling roller 31, the pressure roller 21 and the peeling roller 31 may be rotated with rotation of the heat roller 11.

At the above rotation speeds, when the heat roller 11, the pressure roller 21, and the peeling roller 31 are rotated, the leading end part of the recording paper having been outputted from the transfer section reaches the first nip portion where the heat roller 11 and the pressure roller 21 are in contact with each other. In the present case, the pressure roller 21 is formed with an outer diameter of the order of 18 mm, so that the leading end part of the recording paper is caught by the first nip portion in a preferred manner.

When the recording paper is caught by the first nip portion, the recording paper is transported by rotation of the heat roller 11 and the pressure roller 21. In the present case, the rollers in the fixing device 10 are heated to a fixing temperature by the heater 14 in the heat roller 11. Then, the recording paper having passed through the first nip portion is transported, with rotations of the heat roller 11 and the pressure roller 21, to the second nip portion where the heat roller 11 and the peeling roller 31 are in contact with each other.

In the present case, the recording paper is preferably transported in the state of being close to the heat roller 11 between the first nip portion and the second nip portion. That is, as described above, an area from the first nip portion to the second nip portion along the rotation direction of the heat roller 11 is the virtual nip portion where a heat is given and received from the heat roller 11. Therefore, by completely melting a toner on the recording paper at this virtual nip portion, it is possible to obtain an excellent fixing property.

Thus, as described above, even when the thin-walled heat roller 11 is used for reduced power requirements of the fixing device 11, a sufficient nip width can be ensured while the pressure roller 21 and the peeling roller 31 are pressed to the heat roller 11 without increase in nip pressure. Therefore, the fixing device 10 using the thin-walled heat roller 11 can be also used in a preferred manner in full color printing. That is, even when a large amount of toner is put on a recording paper in a printing like color printing, a toner can be sufficiently melted for an excellent fixing property.

Further, as described with reference to FIGS. 6(*a*) and 6(*b*), positions where the pressure roller 21 and the peeling roller 31 are disposed are set, so that the leading end part of the recording paper having passed through the first nip portion can be more reliably transported to the second nip portion.

Further, the rotation speed V1 of the pressure roller 21 and the rotation speed V2 of the rotation roller 31 are set so as to satisfy the above relation in the above equation, so that the recording paper can be transported without warpage on the recording paper in an area between the first nip portion and the second nip portion. The warpage occurring in the area between the first nip portion and the second nip portion becomes a cause of a trouble such as a paper jam and misalignment of toner images to be fixed on the recording paper, so that prevention of warpage on the recording paper enhances a fixing property of the fixing device 10.

When the recording paper reaches the second nip portion, a melted unfixed toner is fixed on the recording paper at the second nip portion. The second nip portion has a small nip width, as described above, so that a load applied from the peeling roller 31 can be concentrated onto the heat roller 11. Therefore, at the second nip portion, the toner melted at the first nip portion is pushed and hardened for its flattening under pressure than higher than pressure at the first nip portion so as to be fixed on the recording paper. Further, since the high pressure is applied to the recording paper, it is possible to obtain a gloss on the surface of the recording paper.

In the manner as described above, the recording paper having the toner image fixed thereon, after passing through the second nip portion, is peeled from the heat roller 11 and the peeling roller 31. At the second nip portion, a load is concentrated onto a narrow nip width, whereby a pressure required for peeling the recording paper can be obtained. Therefore, it is possible to peel the recording paper in a preferred manner. A property of peeling the recording paper and a paper output direction (ejection direction) can be controlled by a load that occurs at the second nip portion. Specifically, the higher a load at the second nip portion, the further the recording paper is outputted in the direction away from the heat roller 11, which enhances a peeling property. Thus, controlling a load at the second nip portion can control the paper output direction of the recording paper from the fixing device 10, so that the paper output direction can be adjusted in accordance with a position where a paper ejection system (ejection system) of the printer (described later) is disposed.

Thus, after the recording paper having the toner image fixed thereon is peeled at the second nip portion, the melted toner is completely hardened by natural cooling, and the recording paper is sent out toward the paper ejection system of the printer (described later).

As described above, the fixing device 10 of the present embodiment is provided with the thin-walled heat roller 11 (the metal cylinder 12 and the heating-side elastic layer 13 making up the heat roller 11) so that a heat capacity of the heat roller 11 can be reduced. Further, outer diameters of the pressure roller 21 and the peeling roller 31 are smaller than an outer diameter of the heat roller 11. Therefore, in the fixing device 10 of the present embodiment, the thin-walled heat roller 11 decreases its stiffness, but ensures an adequate load and peeling property at the second nip portion and ensures an adequate nip width at the first nip portion.

That is, a small nip width at the nip portion and a low pressure in pushing the peeling roller 31 onto the heat roller 11 provide concentration of a load between the heat roller 11 and the peeling roller 31. This makes it possible, under a pressure applied to such a degree that no deformation and breaking occur in the heat roller 11, to fix a toner image onto the recording paper and to ensure an adequate property of peeling the recording paper from the heat roller 11.

Further, the heat roller 11 is provided with the heating-side elastic layer 13 and the pressure roller 21 is provided with the pressure-application-side elastic layer 23, so that a nip width at the first nip portion can be increased. With this arrangement, it is possible to adequately melt an unfixed toner on the recording paper.

Further, by decreasing the outer diameters of the pressure roller 21 and the peeling roller 31, it is possible to dispose the pressure roller 21 and the peeling roller 31 so as to be close to each other. Also, it is possible to reduce heat capacities of the pressure roller 21 and the peeling roller 31. This can realize size reduction of the fixing device 10. Further, the fixing device 10, as compared with a fixing device having rollers of the same outer diameter, reduces the time and amount of electrical power required for warm-up, thus realizing reduction in power requirements of the fixing device 10.

Note that, a surface hardness of the heat roller 11 may be set so as to be higher than that of the pressure roller 21 but lower than that of the peeling roller 31. With this arrangement, as illustrated in FIG. 1, at the first nip portion, the heat roller 11's push with respect to the pressure-application-side elastic layer 23 of the pressure roller 21 provides the pressure roller 21 with a hollow on its surface. Thus, if the surface hardness of the peeling roller 31 is higher than that of the heat roller 11, the recording paper is transported along the surface of the peeling roller 31.

Further, a peeling property with respect to the recording paper also varies depending on an outer diameter of the peeling roller 31. Therefore, under the condition where the surface hardness of the peeling roller 31 is higher than that of the heat roller 11, the smaller the outer diameter of the peeling roller 31, the recording paper passing through the second nip portion is outputted and transported in the direction in which proximity to the heat roller 11 is decreased. That is, the smaller the outer diameter of the peeling roller 31, the higher the property of peeling from the heat roller 11.

Further, in the fixing device 10, the heat roller 11 is provided with the heat source. However, the fixing device 10 may be arranged such that the pressure roller 21, the peeling roller 31, or the like is provided with a heat source. Alternatively, the fixing device 10 may be arranged such that at least one of the pressure roller 21 and the peeling roller 31, not the heat roller 11, is provided with the heat source.

Figure 7:
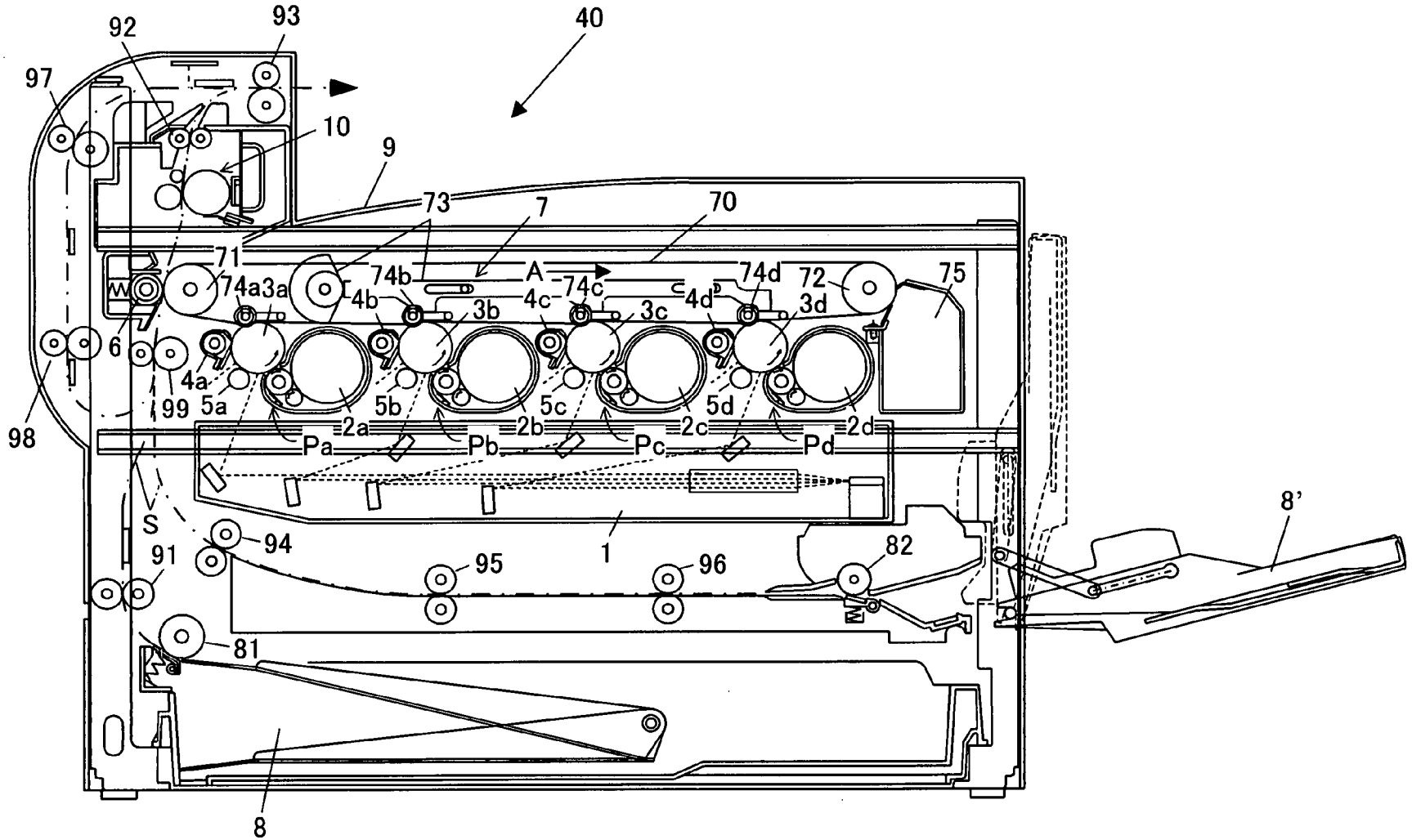
FIG. 7 is a cross-sectional diagram schematically illustrating one embodiment of a printer in the present invention including the fixing device.

Next, the following will describe a printer (image forming apparatus) 40 including the fixing device 10. FIG. 7 is a cross-sectional diagram schematically illustrating the printer 40 of the present embodiment. The printer 40 forms a multicolored or monochrome image on a predetermined recording paper in accordance with image data transmitted from each terminal device on a network (not shown), for example. Therefore, a full-color print mode and a monochrome print mode are selectable in the printer 40.

The printer 40 includes, in addition to the previously-described fixing device 10, an exposure unit 1, image-forming stations P (Pa, Pb, Pc, and Pd), an intermediate transfer belt unit 7, a transfer roller 6, a paper feed tray 8, and a paper ejection tray (paper ejection system, paper output system) 9.

The printer, which is capable of supporting for full-color printing and monochrome printing, has aligned therein four image forming stations Pa, Pb, Pc, and Pd respectively corresponding to the following colors: black (K), cyan (C), magenta (M), and yellow (Y). That is, the image forming station Pa provides image formation using a toner of black (K), the image forming station Pb provides image formation using a toner of cyan (C), the image forming station Pc provides image formation using a toner of magenta (M), and the image forming station Pd provides image formation using a toner of yellow (Y).

Each of the image forming stations Pa through Pd, which has substantially the same structure, includes a developing device 2 (2*a*, 2*b*, 2*c*, and 2*d*), a photosensitive drum 3 (3*a*, 3*b*, 3*c*, and 3*d*), a cleaner unit 4 (4*a*, 4*b*, 4*c*, and 4*d*), and an electrostatic charging device 5 (5*a*, 5*b*, 5*c*, and 5*d*). Note that, letters a through d given to the reference numerals of the members in the above and following descriptions correspond to letters a through d given to the image forming stations P.

The exposure unit 1 at the lower part of the printer 40 exposes the surfaces of the respective photosensitive drums 3*a* through 3*d* electrostatically charged by the electrostatic charging devices 5 in accordance with image data received by the printer 40, thereby forming electrostatic latent images on the surfaces of the respective photosensitive drums 3*a* through 3*d*. As illustrated in FIG. 7, the exposure unit 1 is, for example, a laser scanning unit (LSU) including a laser irradiation section and a reflection mirror. Note that, as the exposure unit 1, the LSU may be replaced with, for example, an EL writing head or an LED writing head having light emitting elements arranged in an array manner.

The electrostatic charging devices 5*a* through 5*d* respectively provided in the image forming stations Pa through Pd electrostatically charge the surfaces of the photosensitive drums 3*a* through 3*d*, respectively, equally at a predetermined potential. As illustrated in FIG. 7, the electrostatic charging devices 5*a* through 5*d* may be contact-type rollers or brushes, or noncontact-type chargers. Further, the developing devices 2*a* through 2*d* develop electrostatic latent images formed on the surfaces of the respective photosensitive drums 3*a* through 3*d*, using the color toners. The cleaner units 4*a* through 4*d*, after a developing process in the developing devices 2*a* through 2*d* and transfer of the images formed on the photosensitive drums 3*a* through 3*d*, remove and retrieve residual toner from the surfaces of the photosensitive drums 3*a* through 3*d*.

The intermediate transfer belt unit 7 includes an intermediate transfer belt 70, an intermediate transfer belt drive roller 71, an intermediate transfer belt driven roller 72, an intermediate transfer belt tension system 73, intermediate transfer rollers 74 (74*a*, 74*b*, 74*c*, and 74*d*), and an intermediate transfer belt cleaning unit 75.

The intermediate transfer belt 70 is continuously formed with a film of 100 μm to 150 μm in thickness. The intermediate transfer belt 70 is provided so as to come into contact with the photosensitive drums 3*a* through 3*d*, and toner images with colors formed on the photosensitive drums 3*a* through 3*d* are sequentially transferred onto the intermediate transfer belt 70. If toner images with colors are overlapped on the intermediate transfer belt 70, colored toner images (multicolor-toner images) are formed on the intermediate transfer belt 70. The toner images formed on the intermediate transfer belt 70 are transferred onto a recording paper by the transfer roller 6 which will be described later.

The intermediate transfer belt 70 lays in a tensioned state across the intermediate transfer belt drive roller 71, the intermediate transfer belt driven roller 72, the intermediate transfer belt tension system 73, and the intermediate transfer rollers 74*a*, 74*b*, 74*c*, and 74*d*, for its rotation in a direction indicated by an arrow A in FIG. 7.

Further, the intermediate transfer rollers 74*a* through 74*d* are respectively provided for the image forming stations Pa through Pd and are rotatably supported to an intermediate transfer roller attachment section of the intermediate transfer belt tension system 73. The intermediate transfer rollers 74*a* through 74*d* are provided so as to be opposed to the photosensitive drums 3*a* through 3*d* via the intermediate transfer belt 70 and offer a transfer bias for transferring, to the intermediate transfer belt 7, the toner images formed on the surfaces of the photosensitive drums 3*a* through 3*d*.

For this arrangement, each of the intermediate transfer rollers 74*a* through 74*d* is composed of (a) a metallic shaft being made of metal such as stainless and having 8 mm to 10 mm in diameter and (b) a conductive elastic material, such as EPDM (ethylene-propylene-methylene copolymer) or urethane foam, with which the surface of the metallic shaft is covered. Then, when a high-voltage transfer bias (high voltage of the polarity (+) opposite to the polarity (−) of electrostatically-charged toner) for transferring the toner images is applied to the intermediate transfer rollers 74*a* through 74*d*, the transfer bias is uniformly applied to the intermediate transfer belt 70 via the conductive elastic material. Note that, the present embodiment adopts the roller-shaped intermediate transfer rollers 74*a* through 74*d*. Instead of the roller-shaped intermediate transfer rollers 74*a* through 74*d*, adoption of transfer electrodes in the form of brushes also allows for obtaining of the same function.

Further, the intermediate transfer belt cleaning unit 75 removes and retrieves a toner depositing to the intermediate transfer belt 70, caused by a contact with the photosensitive drums 3*a* through 3*d*, or residual toner remaining on the intermediate transfer belt 70 without being transferred to the recording paper. This prevents color mixture of toners in a printing process following the developing process. The intermediate transfer belt cleaning unit 75 is provided with, for example, a cleaning blade which comes into contact with the intermediate transfer belt 70. With an arrangement in which the cleaning blade is provided opposed to the intermediate transfer belt driven roller 72 via the intermediate transfer belt 70, it is possible to remove the toner in a preferred manner.

The transfer roller 6 transfers, to the recording paper, the toner images formed on the intermediate transfer belt 70. The transfer roller 6 is disposed so as to press the intermediate transfer belt 70 at a position where the recording paper comes into contact with the intermediate transfer belt 70. The transfer roller is provided so as to be opposed to the intermediate transfer belt drive roller 71 via the intermediate transfer belt 70. For this arrangement, it is preferable that at least one of the transfer roller 6 and the intermediate transfer belt drive roller 71 is formed of a hard material such as metal, and the other is an elastic roller formed of a soft material such as elastic rubber or foaming resin so that the transfer roller 6 presses the intermediate transfer belt 70 with a predetermined pressure. To the transfer roller 6 applied is a voltage for transferring, to the recording paper, the toner images formed on the intermediate transfer belt 70 (high voltage of the polarity (+) opposite to the polarity (−) of electrostatically-charged toner).

The paper feed tray 8 is a tray for storing recording papers for use in image formation and is provided under the image forming stations Pa through Pd and the exposure unit 1 in the printer 40.

Further, the printer 40 includes a manual paper feed tray 8' for use in user's printing of a few recording papers. The manual paper feed tray 8' at one end is rotatably attached to the side of the printer 40. Therefore, as indicated by dashed lines in FIG. 7, during periods of non-use, the manual paper feed tray 8' at its recording paper placing surface is placed along the side of the printer 40, which makes the printer 40 more compact. On the other hand, for manual supply of recording papers to the printer 40, the manual paper feed tray 8' at the recording paper placing surface is moved so as to be away from the side of the printer 40, whereby recording papers can be placed on the recording paper placing surface.

The paper ejection tray 9, which is provided to the upper part of the printer 40, is a tray on which a printed recording paper is placed face down.

The operation of the printing process in the above-arranged printer 40 is performed as follows: when the printer 40 externally receives image data, a pickup roller 81 which is provided at the end of the paper feed tray 8 feeds recording papers loaded in the paper feed tray 8 one by one to a paper transport path S (indicated by alternate long and short dashed lines in FIG. 7). Thereafter, the recording paper is transported to a resist roller 99 by a transport roller 91. When the leading end of the recording paper reaches the resist roller 99, transport of the recording paper is stopped once.

Meanwhile, for transport of recording papers placed on the manual paper feed tray 8', a pickup roller 82 feeds the recording papers one by one to the paper transport path S. Thereafter, the recording paper is transported by a plurality of transport rollers 96, 95, and 94 to the resist roller 99.

Paralleling feeding of the recording paper from the paper feed tray 8 or the manual paper feed tray 8', the image forming stations Pa through Pd start forming toner images in accordance with the received image data. That is, when the printer 40 receives image data, electrostatic charging devices 5*a* through 5*d* electrostatically charge the surfaces of the photosensitive drums 3*a* through 3*d*. Thereafter, the exposure unit 1 forms electrostatic latent images on the surfaces of the photosensitive drums 3*a* through 3*d* in accordance with the received image data. To develop the electrostatic latent images, toners are supplied from the developing devices 2*a* through 2*d* for formation of toner images. Then, the intermediate transfer rollers 74*a* through 74*d* sequentially transfer the toner images formed on the photosensitive drums 3*a* thorough 3*d* to the intermediate transfer belt 70 so that toner images of the four colors are overlapped on the intermediate transfer belt 70 for formation of multi-color toner images. Note that, in the case of monochrome printing, only a toner image of black (K) is formed on the intermediate transfer belt 70.

Thus, when the toner images are formed on the intermediate transfer belt 70, the recording paper starts being transported from the resist roller 99 at such a timing that the recording paper aligns with leading ends of the toner images. When the recording paper passes between the transfer roller 6 and the immediate transfer belt 70, the toner images are transferred on the recording paper. Thereafter, after the toner images on the recording paper are melted and firmly adhered by the fixing device 10, the recording paper is ejected on the paper ejection tray 9 by a paper ejection roller (paper ejection system, paper output system) 92 and a paper ejection roller (paper ejection system, paper output system) 93.

As described previously, a direction in which the recording paper is outputted from the fixing device 10 can be controlled by a pressure load between the peeling roller 31 and the heat roller 11. That is, how much load pressure the peeling roller 31 applies to the heat roller 11 is determined so that the recording paper transported from the fixing device 10 is ejected to a position where the paper ejection system (paper output system), such as the paper ejection rollers 92 and 93 and the paper ejection tray 9, is disposed. Therefore, the printer 40 controls a pressure load between the peeling roller 31 and the heat roller 11 so that the recording paper is outputted in the direction of the paper ejection roller 92. This ensures transport of the recording paper outputted from the fixing device 10 to the paper ejection roller 92.

If duplex printing is required, a back end of the recording paper is caught by the paper ejection roller 93 after passing through the fixing device 10. When the paper ejection roller 93 is rotated backward while catching the back end of the recording paper, the recording paper is guided by transport rollers 97 and 98 and reaches the resist roller 99 again. Thereafter, as described previously, the recording paper is transported in accordance with rotation of the intermediate transfer belt 70 on which the toner images are transferred so that printing on the surface of the recording paper opposite to the previously printed surface can be performed.

Note that, the present embodiment has been described taking a printer as an example. However, the fixing device 10 can be also applied in a similar manner to various types of image forming apparatuses capable of electrophotographic image formation, such as a digital multifunction apparatus including the functions of a printer, a copier, a facsimile machine, and others.

A fixing device according to the present invention, as described above, includes: a first pressure roller which provides a first nip portion by pressing the fixing roller and catches the recording medium having been externally transported to the first nip portion; and a second pressure roller which provides a second nip portion by pressing the fixing roller and peels the recording medium having passed though the second nip portion from the fixing roller, the first pressure roller being disposed upstream to the second pressure roller in a transport direction of the recording medium. An image forming apparatus of the present invention includes the foregoing fixing device.

Thus, by using the fixing device including the first pressure roller having a fixing capability and the second pressure roller having a peeling capability, it is possible to realize a preferred and excellent fixing process.

Further, in a fixing device of the present invention, the following relation is satisfied between the heat roller (fixing roller) having a heat source, the first pressure roller for catching the externally supplied recording medium in the fixing device and transporting it, and the second pressure roller for peeling the recording medium:

an outer diameter of the heat roller>an outer diameter of the first pressure roller>an outer diameter of the second pressure roller.

Thus, the first pressure roller and the second pressure roller are smaller in size than the heat roller, so that the first pressure roller and the second pressure roller can be disposed close to each other. With this arrangement, it is possible to prevent a warpage on the recording medium in an area between the first nip portion and the second nip portion, thus decreasing the occurrence of a paper jam. Further, by preventing a warpage on the recording medium, it is possible to prevent displacement of a developing agent to be fixed on the recording medium when the recording medium passes through the first nip portion and the second nip portion. Still further, the first pressure roller and the second pressure roller are smaller in size, so that it is possible to realize size reduction of the fixing device.

Further, the outer diameter of the first pressure roller is formed smaller than that of the heat roller but larger than that of the second pressure roller. Therefore, the recording medium transported to the fixing device is caught at the first nip portion. This facilitates delivery of the recording medium to the first nip portion. Still further, the second pressure roller is the smallest in outer diameter among the three rollers, so that the nip width of the second nip portion becomes narrow. Therefore, the second pressure roller with its pressure load concentrated can press the heat roller, thus peeling the recording medium in a preferred manner even with a small pressure load.

Further, smaller outer diameters of the first and second pressure rollers can decrease a time (warm-up time) and amount of electrical power required for warming up the rollers in the fixing device from a room temperature to a predetermined fixing temperature. Therefore, a fixing device of the present invention can perform a warm-up at a high speed and realize size reduction and lower power requirements, when compared with the conventional fixing device.

In a fixing device according to the present invention, the heat roller is made up of (a) a hollow cylinder having a wall thickness of 3 mm or less with thermal conductivity and (b) a heat-roller-side elastic layer having a thickness of 1 mm or less with elasticity, the heat-roller-side elastic layer being formed around the hollow cylinder. This can realize a thin-walled heat roller. Therefore, it is possible to reduce heat capacities of the cylinder and the heat-roller-side elastic layer (accumulation section) where heat generated from the heat source of the heat roller is accumulated. Further, the accumulation section is reduced in thickness, so that the amount of heat released can be reduced. With this arrangement, it is possible to reduce a warm-up time of the heat roller and the amount of electrical power required for warm-up, thus realizing low power requirements of the fixing device.

Further, the second pressure roller is reduced in size, so that the nip width of the second nip portion is narrow. Therefore, the second pressure roller can press the heat roller, with its pressure load concentrated onto the narrow nip width, so that it is possible to peel the recording medium in a preferred manner even with a small pressure load which is applied to the second pressure roller. When the second pressure roller presses the thin-walled heat roller that is a hollow cylinder, a pressure load applied from the second pressure roller to the heat roller is small. This avoids deformation and breaking of the heat roller.

In a fixing device according to the present invention, a pressure load of the first pressure roller which presses the heat roller is lower than a pressure load of the second pressure roller which presses the heat roller. With this arrangement, a pressure load at the first nip portion is small, so that it is possible to prevent the developing agent from firmly adhering to the heat roller even when the recording medium passes through the first nip portion in a state where a sufficient amount of heat is not given to the developing agent. In addition, a pressure load at the second nip portion is large, so that it is possible to sufficiently flatten the developing agent and then fix it on the recording medium.

In a fixing device according to the present invention, the first nip portion is larger than the second nip portion in nip width. Therefore, first, it is possible to bring the recording medium into contact with the heat roller at the first nip portion. Then, the recording medium in contact with the heat roller is transported from the first nip portion to the second nip portion. With this arrangement, the recording medium can be heated in an area between the first nip portion and the second nip portion, so that it is possible to give a more amount of heat to the developing agent for a sufficient melting of the developing agent. A nip width at the second nip portion is narrow, so that it is possible to peel, from the heat roller, the recording medium having passed through the second nip portion.

Still further, in a fixing device according to the present invention, it is preferable that the heat roller on its surface has a heat-roller-side elastic layer having elasticity, and the first pressure roller has, around a surface of a cylindrical rotating body, a first pressure-roller-side elastic layer that is an elastic layer made of material which is the same as that of the heat-roller-side elastic layer.

Yet further, in a fixing device according to the present invention, it is preferable that the heat roller on its surface has a heat-roller-side elastic layer having elasticity, and the second pressure roller has, around a cylindrical shaft, a second pressure-roller-side elastic layer that is an elastic layer made of material which is the same as that of the heat-roller-side elastic layer.

This arrangement provides the same surface hardness, so that it is possible to provide the first nip portion and the second nip portion in a flat manner and with a sufficient nip width. Therefore, at the first and second nip portions, it is possible to transport the recording medium without curling. In addition, the first pressure-roller-side elastic layer and the second pressure-roller-side elastic layer are provide, so that it is possible to peel the recording medium in an excellent manner even when printing is performed on a back side of the recording medium during duplex printing.

A fixing device according to the present invention is such that in the foregoing fixing device, the first pressure roller has a surface hardness lower than that of the heat roller, and the second pressure roller has a surface hardness higher than that of the heat roller.

With this arrangement, the recording medium is transported along a pressure roller having a higher surface hardness, so that it is possible to transport, along the heat roller, the recording medium having passed through the first nip portion. Therefore, a much more amount of heat is supplied from the heat roller to the recording medium transported in an area between the first nip portion and the second nip portion, so that the developing agent can be melted sufficiently. Further, it is possible to prevent the occurrence of a paper jam caused when the recording medium having passed through the first nip portion strikes the second pressure roller, whereby it is possible to ensure transport of the recording medium to the second nip portion. Still further, the recording medium having passed through the second nip portion is transported along the second pressure roller, so that the recording medium is transported in the direction far away from the heat roller. This enhances a peeling property with respect to the recording medium.

In a fixing device according to the present invention, a rotation speed V2 of the second pressure roller is equal to or higher than a rotation speed V1 of the first pressure roller.

More specifically, with respect to a rotation speed V1 of the first pressure roller, a rotation speed V2 of the second pressure roller satisfies the following relation:

$$V1\times1.0\leqq V2\leqq V1\times1.1.$$

With this arrangement, it is possible to prevent the recording medium from sagging in an area between the first nip portion and the second nip portion even when the recording medium having been transported to the first nip portion is heated and expanded. Further, the recording medium in contact with the heat roller is reliably transported to the second nip portion, so that it is possible to maintain a constant transporting condition of the recording medium. Therefore, by using a fixing device of the present invention, it is possible to fix the developing agent on the recording medium in an excellent manner.

An image forming apparatus according to the present invention includes any one of the foregoing fixing devices. That is, the fixing roller is a heat roller having a heat source, and there is the following relation between the heat roller, the first pressure roller, and the second pressure roller:

an outer diameter of the heat roller>an outer diameter of the first pressure roller>an outer diameter of the second pressure roller.

Therefore, an image forming apparatus of the present invention can provide an image forming apparatus that realizes size reduction and low power requirements while securing an excellent property of fixing a toner image to the recording medium.

Further, an image forming apparatus according to the present invention further includes: an ejection system for ejecting the recording medium, wherein: a pressure load of the second pressure roller which presses the heat roller is set so that the recording medium having been transported from the fixing device can be ejected to a position where the ejection system is disposed.

The fixing device, by controlling a pressure load of the second pressure roller, can adjust an ejection direction of the recording medium which is ejected from the second nip portion. Therefore, even when limitations are imposed on the positions of elements in the image forming apparatus, it is possible to reliably transport the recording medium having been ejected from the second nip portion to the ejection system in accordance with the position where the ejection system is disposed, by adjusting a pressure load of the second pressure roller.

Still further, an image forming apparatus according to the present invention may be such that a monochrome printing mode and a full-color printing mode are selectable.

An fixing device of the present invention can fix the developing agent in a preferred and excellent manner regardless of whether the amount of developing agent to be fixed on the recording medium is small or large. Therefore, it is possible to use the foregoing fixing device in a preferred manner in both the monochrome printing mode where a small amount of developing agent is used and the full-color printing mode where a large amount of developing agent is used. Accordingly, the foregoing fixing device can be used in a preferred manner for the image forming apparatus which performs an image forming process in both the monochrome printing mode and the full-color printing mode.

In a fixing device according to the present invention, press positions where the first and second pressure rollers press the fixing roller are set so that, in a cross section orthogonal to central axes of the fixing roller and the pressure rollers, a first orthogonal line being orthogonal to a first line that connects a center of the fixing roller and a center of the first pressure roller and passing through the first nip portion, comes into contact with a contact area in a predetermined area on a peripheral surface of the second pressure roller. Here, the contact area is an area between (a) an intersection position where a second orthogonal line being orthogonal to a second line that connects the center of the fixing roller and a center of the second pressure roller and passing through the center of the second pressure roller intersects with a peripheral surface of the second pressure roller on the first pressure roller's side and (b) an end part of the second nip portion upstream in the transport direction of the recording medium.

The first orthogonal line is a transport direction of the recording medium passing through the first nip portion. The intersection position is a boundary point where the leading end part of the recording medium slides over the surface of the second pressure roller toward the second nip portion under the situation where the leading end part of the recording medium comes into contact with the first pressure roller, and thereafter, the recording medium is further transported, and the second pressure roller rotates. Therefore, in the above arrangement, the positions where the first pressure roller and the second pressure roller are disposed are set so that the first orthogonal line comes into contact with a contact area in the foregoing area.

With this arrangement, the recording medium cannot be transported in intimate contact with the fixing roller in an area between the first nip portion and the second nip portion. When the recording medium comes into contact with the surface of the second pressure roller, the leading end part of the recording medium comes into contact with the foregoing contact area, so that it is possible to transport the recording medium to the second nip portion in an excellent manner. Therefore, it is possible to transport the recording medium in a preferred manner while preventing the occurrence of a paper jam in an area between the first nip portion and the second nip portion.

In a fixing device according to the present invention, a straight line extending from the first orthogonal line toward the second pressure roller passes through the center of the second pressure roller, and the contact area is an area between (i) an intersection position where the straight line intersects with a peripheral surface of the second pressure roller on the first pressure roller's side and (ii) an end part of the second nip portion upstream in the transport direction of the recording medium.

With this arrangement, the leading end part of the recording medium comes into contact with the second pressure roller, and thereafter, the recording medium is transported, so that the recording medium can be sent to the second nip portion. Therefore, according to the foregoing arrangement, it is possible to more reliably transport the recording medium from the first nip portion to the second nip portion.

Further, in a fixing device according to the present invention, the following relation is satisfied between the fixing roller, the first pressure roller, and the second pressure roller:

an outer diameter of the fixing roller>an outer diameter of the first pressure roller>an outer diameter of the second pressure roller. Thus, the first pressure roller and the second pressure roller are smaller in size than the fixing roller, so that the first pressure roller and the second pressure roller can be disposed close to each other. In addition, the first pressure roller and the second pressure roller are smaller in size, so that it is possible to realize size reduction of the fixing device.

Further, the outer diameter of the first pressure roller is formed smaller than that of the fixing roller but larger than that of the second pressure roller. Therefore, the recording medium transported to the fixing device is caught at the first nip portion. This facilitates delivery of the recording medium to the first nip portion. Still further, the second pressure roller is the smallest in outer diameter among the three rollers, so that the nip width of the second nip portion becomes narrow. Therefore, the second pressure roller with its pressure load concentrated can press the fixing roller, thus peeling the recording medium in a preferred manner even with a small pressure load.

Further, smaller outer diameters of the first and second pressure rollers can decrease a time (warm-up time) and amount of electrical power required for warming up the rollers in the fixing device from a room temperature to a predetermined fixing temperature. Therefore, a fixing device of the present invention can perform a warm-up at a high speed and realize size reduction and lower power requirements, when compared with the conventional fixing device.

A fixing device according to the present invention is such that, in the foregoing fixing device, the fixing roller has a heat source and is made up of (a) a hollow cylinder having a wall thickness of 3 mm or less with thermal conductivity and (b) a fixing-roller-side elastic layer having a thickness of 1 mm or less with elasticity, the fixing-roller-side elastic layer being formed around the hollow cylinder. This can realize a thin-walled fixing roller. Therefore, it is possible to reduce heat capacities of the cylinder and the fixing-roller-side elastic layer (accumulation section) where heat generated from the heat source of the fixing roller is accumulated. Further, the accumulation section is reduced in thickness, so that the amount of heat released can be reduced. With this arrangement, it is possible to reduce a warm-up time of the fixing roller and the amount of electrical power required for warm-up, thus realizing low power requirements of the fixing device.

Further, the second pressure roller is reduced in size, so that the nip width of the second nip portion is narrow. Therefore, in this case, the second pressure roller can press the fixing roller, with its pressure load concentrated onto the narrow nip width, so that it is possible to peel the recording medium in a preferred manner even with a small pressure load which is applied to the second pressure roller. When the second pressure roller presses the thin-walled fixing roller that is a hollow cylinder, a pressure load applied from the second pressure roller to the fixing roller is small. This avoids deformation and breaking of the fixing roller.

In a fixing device according to the present invention, the first nip portion is larger than the second nip portion in nip width. With this arrangement, it is possible to give a more amount of heat to the developing agent for a sufficient melting of the developing agent, when the recording medium passes through the first nip portion.

A fixing device according to the present invention is such that in the foregoing fixing device, the first pressure roller has a surface hardness lower than that of the fixing roller, and the second pressure roller has a surface hardness higher than that of the fixing roller.

With this arrangement, the recording medium is transported along a pressure roller having a higher surface hardness, so that it is possible to transport, along the fixing roller, the recording medium having passed through the first nip portion. Therefore, it is possible to prevent the occurrence of a paper jam caused when the recording medium having passed through the first nip portion strikes the second pressure roller, whereby it is possible to ensure transport of the recording medium to the second nip portion. Further, the recording medium having passed through the second nip portion is transported along the second pressure roller, so that the recording medium is transported in the direction far away from the fixing roller. This enhances a peeling property with respect to the recording medium.

An image forming apparatus according to the present invention includes any one of the foregoing fixing devices. That is, press positions where the first and second pressure rollers press the fixing roller are set so that, in a cross section orthogonal to central axes of the fixing roller and the pressure rollers, a first orthogonal line being orthogonal to a first line that connects a center of the fixing roller and a center of the first pressure roller and passing through the first nip portion, comes into contact with a contact area in a predetermined area on a peripheral surface of the second pressure roller, and the contact area is an area between (a) an intersection position where a second orthogonal line being orthogonal to a second line that connects the center of the fixing roller and a center of the second pressure roller and passing through the center of the second pressure roller intersects with a peripheral surface of the second pressure roller on the first pressure roller's side and (b) an end part of the second nip portion upstream in the transport direction of the recording medium.

This brings the effect of transporting the recording medium from the first nip portion to the second nip portion in a preferred manner while preventing the occurrence of a paper jam in the fixing device, when the recording medium, such as a piece of recording paper and plural pieces of recording paper stacked, is transported.

Further, outer diameters of the two pressure rollers included in the fixing device are made smaller than an outer diameter of the fixing roller, so that it is possible to realize size reduction and lower power requirements of the fixing device. Therefore, it is possible to provide an image forming apparatus which realizes size reduction and low power requirements.

The fixing device of the present invention can be used in image forming apparatuses such as printer, copier, facsimile machine, all of which perform image formation using a toner by electrophotography, and a digital multifunction apparatus including the functions of the printer, the copier, and the facsimile machine.

The foregoing fixing device can adequately ensure a property of fixing a toner image on the recording paper and a property of peeling the recording medium, thus enabling support for both monochrome printing and color printing.

Further, the foregoing fixing device realizes an excellent transport of the recording medium without causing a paper jam in an area between the first nip portion and the second nip portion and enables an preferred and excellent fixing process.

Still further, the thin-walled heat roller, and the pressure roller and the peeling roller having small outer diameters achieve size reduction and power requirements reduction of the fixing device, and realize size reduction and power requirements reduction of the image forming apparatus including the fixing device.

Specific embodiments or examples implemented in the description of the embodiments only show technical features of the present invention and are not intended to limit the scope of the invention. Variations can be effected within the spirit of the present invention and the scope of the following claims.

What is claimed is:

1. A fixing device, comprising:

a fixing roller, where the fixing roller is a heat roller having a heat source; and at least two pressure rollers providing respective nip portions by pressing the fixing roller, wherein the fixing roller and the pressure rollers rotate, thereby transporting a recording medium to the nip portions and fixing a developing agent on the recording medium, the at least two pressure rollers including:

a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, and the first pressure roller being disposed upstream to the second pressure roller in a transport direction of the recording medium, wherein the heat roller, the first pressure roller, and the second pressure roller satisfy the following relationship; an outer diameter of the heat roller>an outer diameter of the first pressure roller>an outer diameter of the second pressure roller, and wherein the heat roller is made up of (a) a hollow cylinder having a wall thickness of 3 mm or less with thermal conductivity and (b) a heat-roller-side elastic layer having a thickness of 1 mm or less with elasticity, the heat-roller-side elastic layer being formed around the hollow cylinder.

2. The fixing device according to claim 1, wherein:

a pressure load of the first pressure roller which presses the heat roller is lower than a pressure load of the second pressure roller which presses the heat roller.

3. The fixing device according to claim 2 wherein:

the heat roller on its surface has a heat-roller-side elastic layer having elasticity, and the first pressure roller has, around a surface of a cylindrical rotating body, a first pressure-roller-side elastic layer that is an elastic layer made of material which is the same as that of the heat-roller-side elastic layer.

4. The fixing device according to claim 2 wherein:

the heat roller on its surface has a heat-roller-side elastic layer having elasticity, and the second pressure roller has, around a cylindrical shaft, a second pressure-roller-side elastic layer that is an elastic layer made of material which is the same as that of the heat-roller-side elastic layer.

5. The fixing device according to claim 1, wherein:

the first nip portion is larger than the second nip portion in nip width.

6. The fixing device according to claim 5, wherein:

the heat roller on its surface has a heat-roller-side elastic layer having elasticity, and the first pressure roller has, around a surface of a cylindrical rotating body, a first pressure-roller-side elastic layer that is an elastic layer made of material which is the same as that of the heat-roller-side elastic layer.

7. The fixing device according to claim 5, wherein:

the heat roller on its surface has a heat-roller-side elastic layer having elasticity, and the second pressure roller has, around a cylindrical shaft, a second pressure-roller-side elastic layer that is an elastic layer made of material which is the same as that of the heat-roller-side elastic layer.

8. The fixing device according to claim 1, wherein:

the first pressure roller has a surface hardness lower than that of the heat roller, and the second pressure roller has a surface hardness higher than that of the heat roller.

9. A fixing device, comprising:

a fixing roller, where the fixing roller is a heat roller having a heat source; and at least two pressure rollers providing respective nip portions by pressing the fixing roller, wherein the fixing roller and the pressure rollers rotate, thereby transporting a recording medium to the nip portions and fixing a developing agent on the recording medium, the at least two pressure rollers including:

a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, and the first pressure roller being disposed upstream to the second pressure roller in a transport direction of the recording medium, wherein the heat roller, the first pressure roller, and the second pressure roller satisfy the following relationship; an outer diameter of the heat roller>an outer diameter of the first pressure roller>an outer diameter of the second pressure roller, and wherein a rotation speed V2 of the second pressure roller is equal to or higher than a rotation speed V1 of the first pressure roller.

10. A fixing device, comprising:

a fixing roller, where the fixing roller is a heat roller having a heat source; and at least two pressure rollers providing respective nip portions by pressing the fixing roller, wherein the fixing roller and the pressure rollers rotate, thereby transporting a recording medium to the nip portions and fixing a developing agent on the recording medium, the at least two pressure rollers including:

a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, and the first pressure roller being disposed upstream to the second pressure roller in a transport direction of the recording medium, wherein the heat roller, the first pressure roller, and the second pressure roller satisfy the following relationship; an outer diameter of the heat roller>an outer diameter of the first pressure roller>an outer diameter of the second pressure roller, and wherein, with respect to a rotation speed V1 of the first pressure roller, a rotation speed V2 of the second pressure roller satisfies the following relation:

$$V1 \times 1.0 \leqq V2 \leqq V1 \times 1.1.$$

11. The fixing device according to claim 10, wherein:

a drive source of the second pressure roller and a drive source of the first pressure roller are different from each other.

12. A fixing device, comprising:

a fixing roller; and at least two pressure rollers providing respective nip portions by pressing the fixing roller, wherein the fixing roller and the pressure rollers rotate, thereby transporting a recording medium to the nip portions and fixing a developing agent on the recording medium, the at least two pressure rollers including:

a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, and the first pressure roller being disposed upstream to the second pressure roller in a transport direction of the recording medium, and wherein press positions where the first and second pressure rollers press the fixing roller are set so that, in a cross section orthogonal to central axes of the fixing roller and the pressure rollers, a first orthogonal line being orthogonal to a first line that connects a center of the fixing roller and a center of the first pressure roller and passing through the first nip portion, comes into contact with a contact area in a predetermined area on a peripheral surface of the second pressure roller, and wherein the contact area is an area between (a) an intersection position where a second orthogonal line being orthogonal to a second line that connects the center of the fixing roller and a center of the second pressure roller and passing through the center of the second pressure roller intersects with a peripheral surface of the second pressure roller on the first pressure roller's side and (b) an end part of the second nip portion upstream in the transport direction of the recording medium.

13. The fixing device according to claim 12, wherein:

a straight line extending from the first orthogonal line toward the second pressure roller passes through the center of the second pressure roller, and the contact area is an area between (i) an intersection position where the straight line intersects with a peripheral surface of the second pressure roller on the first pressure roller's side and (ii) an end part of the second nip portion upstream in the transport direction of the recording medium.

14. The fixing device according to claim 12, wherein:

there is the following relation between the fixing roller, the first pressure roller, and the second pressure roller:

an outer diameter of the fixing roller>an outer diameter of the first pressure roller>an outer diameter of the second pressure roller.

15. The fixing device according to claim 12, wherein:

the fixing roller has a heat source and is made up of (a) a hollow cylinder having a wall thickness of 3 mm or less with thermal conductivity and (b) a fixing-roller-side elastic layer having a thickness of 1 mm or less with elasticity, the fixing-roller-side elastic layer being formed around the hollow cylinder.

16. The fixing device according to claim 12, wherein:

the first nip portion is larger than the second nip portion in nip width.

17. The fixing device according to claim 12, wherein:

the first pressure roller has a surface hardness lower than that of the fixing roller, and the second pressure roller has a surface hardness higher than that of the fixing roller.

18. An image forming apparatus comprising:

a fixing device, including:

a fixing roller; and at least two pressure rollers providing respective nip portions by pressing the fixing roller, wherein the fixing roller and the pressure rollers rotate, thereby transporting a recording medium to the nip portions and fixing a developing agent on the recording medium, the at least two pressure rollers including:

a first pressure roller which provides a first nip portion by pressing the fixing roller and delivers, to the first nip portion, the recording medium having been externally transported; and a second pressure roller which provides a second nip portion by pressing the fixing roller and peels the recording medium having passed though the second nip portion from the fixing roller, and the first pressure roller being disposed upstream to the second pressure roller in a transport direction of the recording medium, wherein press positions where the first and second pressure rollers press the fixing roller are set so that, in a cross section orthogonal to central axes of the fixing roller and the pressure rollers, a first orthogonal line being orthogonal to a first line that connects a center of the fixing roller and a center of the first pressure roller and passing through the first nip portion, comes into contact with a contact area in a predetermined area on a peripheral surface of the second pressure roller, and wherein the contact area is an area between (a) an intersection position where a second orthogonal line being orthogonal to a second line that connects the center of the fixing roller and a center of the second pressure roller and passing through the center of the second pressure roller intersects with a peripheral surface of the second pressure roller on the first pressure roller's side and (b) an end part of the second nip portion upstream in the transport direction of the recording medium.

19. The image forming apparatus according to claim 18, wherein:

the fixing roller is a heat roller having a heat source, and there is the following relation between the heat roller, the first pressure roller, and the second pressure roller:

an outer diameter of the heat roller>an outer diameter of the first pressure roller>an outer diameter of the second pressure roller.

20. The image forming apparatus according to claim 19, further comprising:

an ejection system for ejecting the recording medium, wherein:

a pressure load of the second pressure roller which presses the heat roller is set so that the recording medium having been transported from the fixing device can be ejected to a position where the ejection system is disposed.

21. The image forming apparatus according to claim 19, wherein:

a monochrome print mode and a full-color print mode are selectable.

* * * * *